US007427970B2

(12) United States Patent
Iguchi

(10) Patent No.: US 7,427,970 B2
(45) Date of Patent: Sep. 23, 2008

(54) CIRCUIT FOR DRIVING LIGHT EMITTING ELEMENT AND CURRENT-CONTROL-TYPE LIGHT-EMITTING DISPLAY

(75) Inventor: Koichi Iguchi, Tokyo (JP)

(73) Assignee: NEC Corporation, Tokyo (JP)

( * ) Notice: Subject to any disclaimer, the term of this patent is extended or adjusted under 35 U.S.C. 154(b) by 744 days.

(21) Appl. No.: 10/933,310

(22) Filed: Sep. 3, 2004

(65) Prior Publication Data

US 2005/0062686 A1 Mar. 24, 2005

(30) Foreign Application Priority Data

Sep. 4, 2003 (JP) ..... 2003-312939

(51) Int. Cl.
*G09G 3/30* (2006.01)

(52) U.S. Cl. ..... 345/76; 345/82

(58) Field of Classification Search ..... 345/76–82, 345/204, 84, 87; 315/169.3
See application file for complete search history.

(56) References Cited

U.S. PATENT DOCUMENTS 7,176,857 B2 * 2/2007 Osame et al. ..... 345/76

FOREIGN PATENT DOCUMENTS

JP 2002-169509 6/2002
JP 2003-122304 4/2003

* cited by examiner

*Primary Examiner*—Regina Liang
(74) *Attorney, Agent, or Firm*—Dickstein Shapiro LLP

(57) ABSTRACT

A current-control-type light emitting display in which a reverse current can be supplied to a light emitting element without requiring a negative power supply and without being passed through a forward drive section. A first electrode of the light emitting element is connected via a first switching device to a second power supply line set to 0 V, and is connected to a drive section via a second switching device. A second electrode of the light emitting element is connected to a third power supply line selectively connected to a voltage source from which an arbitrary positive voltage is supplied or another voltage source from which 0 V is supplied. A reverse current is supplied to the light emitting device by setting the potential on the first electrode of the light emitting element equal to the potential on the second power supply line and by setting the potential on the second electrode equal to the potential on the third power supply line from which an arbitrary positive voltage is supplied.

46 Claims, 17 Drawing Sheets

CIRCUIT FOR DRIVING LIGHT EMITTING ELEMENT AND CURRENT-CONTROL-TYPE LIGHT-EMITTING DISPLAY

BACKGROUND OF THE INVENTION

1. Field of the Invention

The present invention relates to a circuit for driving a light emitting element and, more particularly, to a drive circuit for driving a light emitting element which emits light according to an element current. The present invention also relates to a current-control-type light emitting display using a light emitting element which emits light according to an element current.

2. Description of the Related Art

Current-control-type light emitting displays ordinarily have light emitting elements arrayed in matrix form and perform display control utilizing the phenomenon of emission of light from the light-emitting elements. A current-control-type light emitting display of a low current consumption can be realized by using light emitting elements having a high light emission efficiency. The current flowing per unit time in an active-matrix current-control-type light emitting display in particular is lower than that in a simple-matrix current-control-type light-emitting display or the like, and the active-matrix current-control-type light emitting display can display images at a low voltage and a low power consumption. In recent years, organic EL elements capable of emitting light at a low voltage and a low current have been put to use as light emitting elements in active-matrix current-control-type light emitting displays.

Organic electroluminescent (EL) elements can be driven at a low voltage and a low current. However, there are cases where a light-emitting element formed of an organic EL element does not emit light after forming films for the element due to a short-circuit defect which occurs between the anode and the cathode. This short-circuit defect can be removed by applying a voltage higher than a certain value and opposite in polarity to the voltage generated between the anode and the cathode at the time of light emission. In other words, a reverse bias voltage equal to or higher than a certain value is applied between the anode and the cathode of the light emitting element to cause a sufficiently large reverse current to flow through the light emitting element to insulate the short-circuit defect portion. The short-circuit defect can be removed in this way. In a current-control-type light emitting display using organic EL elements, a reverse bias voltage is applied to light emitting elements after film forming for the elements to cause a short-circuit defect, which has occurred, to disappear.

A short-circuit defect as well as that found in the above-described situation may occur in organic EL elements when the organic EL elements are operated by causing only a forward current to flow. Also in this case, the short-circuit defect can be removed by applying a reverse bias voltage to the element to restore the element to the normal light emitting condition. Also, there are cases where the life of organic EL elements is extended due to application of a reverse bias voltage to the elements in comparison with the case where only a forward current is caused to flow. Also from this viewpoint, it is desirable to apply a reverse bias voltage to organic EL elements.

There is described in Japanese Patent Application laid open No. 2003-122304 (reference 1) a known technique for applying a reverse bias voltage to light emitting elements in conventional current-control-type light emitting displays. According to the technique, a reverse bias voltage is applied to light emitting elements for the purpose of extending the life of the light emitting elements. Application of a reverse bias voltage to the light emitting elements in this technique is also effective in reducing short-circuit defects in the elements.

FIG. 1 shows a portion of a conventional display described in reference 1. Referring to FIG. 1, a source signal line 41 through which a signal current is supplied is connected to the drain of a first switching transistor 47*c*, and a first gate signal line 42 is connected to the gate of the first switching transistor 47*c* and to the gate of a second switching transistor 47*b*. The source of the first switching transistor 47*c* is connected to the drain of the second switching transistor 47*b*, the drain of a drive transistor 47*a* and the source of a third switching transistor 47*d*. The source of the drive transistor 47*a* is connected to an EL power supply line 45. The source of the second switching transistor 47*b* is connected to the gate of the drive transistor 47*a* and is also connected to the EL power supply line 45 via a storage capacitor 44.

A second gate signal line 43 is connected to the gate of the third switching transistor 47*d* and the gate of a fourth switching transistor 47*e*. The drain of the fourth switching transistor 47*e* is connected to a reverse bias power supply line 48. One of two electrodes of an EL element 46 is connected to the drain of the third switching transistor 47*d* and the source of the fourth switching transistor 47*e*, while the other electrode of the EL element 46 is connected to a power supply line 49.

In the technique described in reference 1, a voltage of L level is supplied to the first gate signal line 42 during a selection period in one frame period. Each of the second switching transistor 47*b* and the first switching transistor 47*c* is thereby made conductive. At this time, a voltage of H level is supplied to the second gate signal line 43 to set the third switching transistor 47*d* in a shutoff state. As a result, a current controlled according to the signal current supplied from the source signal line 41 is thereby caused to flow through the drive transistor 47*a*, and a voltage according to the signal current supplied from the source signal line 41 is generated at the gate of the drive transistor 47*a* and one end of the storage capacitor 44.

After the end of the selection period, the H-level voltage is supplied to the first gate signal line 42 to set each of the second switching transistor 47*b* and the first switching transistor 47*c* in a shutoff state. Since the second switching transistor 47*b* is set in the shutoff state, the voltage generated at the drive transistor 47*a* and one end of the storage capacitor 44 is held by the storage capacitor 44. At this time, if the voltage supplied to the second gate signal line 43 is at L level, the third switching transistor 47*d* is in the conductive state and the fourth switching transistor 47*e* is in the shutoff state. Consequently, the source-drain current in the drive transistor 47*a* supplied from the EL power supply line 45 flows into the EL element 46 via the third switching transistor 47*d*.

If the voltage supplied to the second gate signal line 43 after the selection period is not at L level but at H level, the third switching transistor 47*d* is in the shutoff state, the fourth switching transistor 47*e* is in the conductive state, and no current flows from the EL power supply line 45 to the EL element 46. In this case, since the fourth switching transistor 47*e* is in the conductive state, a voltage supplied to the reverse bias power supply line 48 to apply a reverse bias voltage to the EL element 46 is applied to one of the two electrodes of the EL element 46. A voltage supplied to the power supply line 49 connected to the other electrode of the EL element 46 is ordinarily 0 V or a negative voltage. Therefore, a negative voltage lower than the voltage applied to the power supply line 49 is supplied to the reverse bias power supply line 48 to reduce the potential on the third switching transistor 47*d*/ fourth switching transistor 47*e* side of the EL element 46 relative to the potential on the power supply line 49 side.

The technique described in reference 1 requires two negative power supplies if the voltage supplied to the power supply line 49 is negative, or one negative power supply if the voltage supplied to the power supply line 49 is 0 V. That is, the technique described above requires at least one negative power supply for application of a reverse bias to the EL element 46. Therefore, it is difficult to reduce the size and manufacturing cost of a display by using the technique. There is another problem as below. Since a negative voltage is applied to the reverse bias power supply line 48 and a voltage of H level is applied to the second gate signal line 43, an excessively high voltage corresponding to the sum of the H-level voltage and the absolute value of the negative voltage is applied between the gate and the source of the third switching transistor 47*d*, between the gate and the drain of the third switching transistor 47*d*, between the gate and the source of the fourth switching transistor 47*e*, and between the gate and the drain of the fourth switching transistor 47*e*. Therefore, gate insulation breakdown or degradation in electrical characteristics can occur easily in the third switching transistor 47*d* and the fourth switching transistor 47*e*.

There is described in Japanese Patent Application laid open No. 2002-169509 (reference 2) another known technique for applying a reverse bias voltage to light emitting elements. According to the technique, a reverse bias voltage is applied to light emitting elements for certain purposes including the purpose of inhibiting life-shortening due to degradation in film quality of the elements. FIG. 2 shows a pixel circuit for a conventional display described in reference 2. In a pixel circuit 54 of a display 50 in FIG. 2, an external power supply 53 is connected to one end of an EL element 56 and the voltage of the external power supply is controlled to apply a reverse bias voltage to the EL element 56. More specifically, the voltage of the external power supply 53 and the voltage on the power supply line 55 are set in a relationship (external power supply 53)>(power supply line 55) to apply a reverse bias voltage to the EL element 56 and supply a reverse bias current to the EL element 56 via a second thin-film transistor 58 for controlling the value of a current supplied to the EL element 56 at the time of light emission.

When the reverse bias voltage is applied to the EL element 56 having a short-circuit defect, a large current several ten times larger than that at the time of light emission is caused to flow through the EL element 56. In ordinarily cases of causing a large current to flow through a device on/off controlled, e.g., a switching device, there is a need to set the size of the device large, for example, a need to set the channel width large in the case of a thin film transistor. In the construction shown in FIG. 2, therefore, the second thin-film transistor 58 as a current control transistor for controlling the current caused to flow through the EL element 56 at the time of light emission needs to have an increased size according to a current which is caused to flow in the reverse direction through the EL element 56 as a reverse current large enough to remove a short-circuit defect.

In the second thin-film transistor 58, however, the channel width cannot be sufficiently increased because the channel width is set to a value for accurately controlling the current supplied to the EL element 56 at the time of light emission. For this reason, the value of the reverse current supplied to the EL element 56 is limited by the second thin-film transistor 58. In the construction shown in FIG. 2, therefore, a sufficiently large reverse current cannot be caused to flow through the EL element 56 and it is difficult to remove a short-circuit defect. A sufficiently large potential difference may be set between the gate and the source of the second thin-film transistor 58 to compensate for the low current performance of the second thin-film transistor 58 and to cause a sufficiently large current to flow through a short-circuit defect portion in the EL element 56 at the time of application of the reverse bias. In such case, however, the voltage applied between the gate and the source is excessively high, there is a possibility of the gate-source voltage exceeding the withstand voltage to break the thin-film transistor, and the reliability of the light emitting display is reduced.

As described above, the technique described in reference 1 requires at least one negative power supply for application of a reverse bias voltage to EL elements and entails difficulty in reducing the size, manufacturing cost and power consumption of a display. Also, a negative voltage is applied to the reverse bias power supply line 48 and a voltage of H level is applied to the second gate signal line 43. Therefore, an excessively high voltage is applied to the third switching transistor 47*d* and the fourth switching transistor 47*e* and gate insulation breakdown and degradation in electrical characteristics occur easily.

According to the technique described in reference 2, a reverse bias voltage is applied through a current control transistor for controlling the current supplied to an EL element at the time of light emission, and no negative power supply is required. However, a large current necessary for insulating a short-circuit portion cannot be caused to flow through the current control transistor, and therefore, it is difficult to remove a short-circuit defect by this technique. The technique described in reference 2 also has a problem in terms of reduction in reliability in that when a large voltage is applied between the gate and the source of the current control transistor to cause a large reverse bias current to flow, destruction of the current control transistor or degradation in electrical characteristic cannot be avoided.

SUMMARY OF THE INVENTION

In view of the above-described problems, an object of the present invention is to provide a light emitting element drive circuit which requires no negative power supply, and which is capable of supplying, at the time of application of a reverse bias, a current large enough to remove a short-circuit defect to the light emitting element without causing any excessively large current to flow through a transistor for controlling the current flowing through the light emitting element, and a current-control-type light emitting display using the light emitting element drive circuit.

To achieve the above-described object, according to the present invention, there is provided a drive circuit for driving a light emitting element which has a first electrode and a second electrode and which emits light by a forward current flowing through the element between the first electrode and the second electrode, the drive circuit comprising a forward drive section which draws out a current from a first power supply line set to a first voltage and supplies the forward current to the light emitting element, and a first switch which establishes a connection between one of the first electrode and the second electrode on which a higher potential is produced relative to a potential on the other when the forward current is caused to flow through the light emitting element, and a second power supply line set to a second voltage, wherein the other of the first electrode and the second electrode on which a lower potential is produced when the forward current is caused to flow through the light emitting element is connected to a third power supply line through which a third voltage higher than the second voltage is supplied, a reverse current being supplied to the light emitting element between the second power supply line and the third power supply line.

A current-control-type light emitting display in a first aspect of the present invention comprises a light emitting element which has a first electrode and a second electrode and which emits light by a forward current flowing through the element between the first electrode and the second electrode, a forward drive section which draws out a current from a first power supply line set to a first voltage and supplies the forward current to the light emitting element, and a first switch which establishes a connection between one of the first electrode and the second electrode on which a higher potential is produced relative to a potential on the other when the forward current is caused to flow through the light emitting element, and a second power supply line set to a second voltage. The other of the first electrode and the second electrode on which a lower potential is produced when the forward current is caused to flow through the light emitting element is connected to a third power supply line through which a third voltage higher than the second voltage is supplied. A reverse current is supplied to the light emitting element between the second power supply line and the third power supply line.

A current-control-type light emitting display in a second aspect of the present invention has a light emitting array in which a plurality of pixel circuits are arrayed in matrix form, a plurality of data lines provided in correspondence with the columns of the light emitting array, luminance data being supplied through the data lines to groups of the pixel circuits arranged in the column direction, and gate lines provided in correspondence with the rows of the light emitting array, gate signals being supplied through the gate lines to groups of the pixel circuits arranged in the row direction. Each of the pixel circuit includes a light emitting element which has a first electrode and a second electrode and which emits light by a forward current flowing through the element between the first electrode and the second electrode, a forward drive section which draws out, in response to the gate signal, a current from a first power supply line set to a first voltage, the current being controlled on the basis of the luminance data, and which supplies the forward current to the light emitting element, and a first switch which establishes a connection between one of the first electrode and the second electrode on which a higher potential is produced relative to a potential on the other when the forward current is caused to flow through the light emitting element, and a second power supply line set to a second voltage. The other of the first electrode and the second electrode on which a lower potential is produced when the forward current is caused to flow through the light emitting element is connected to a third power supply line through which a third voltage higher than the second voltage is supplied, and which is laid in correspondence with the row, a reverse current being supplied to the light emitting element between the second power supply line and the third power supply line.

In the light emitting element drive circuit and the current-control-type light emitting display of the present invention, a reverse current flowing in a direction opposite to the direction in which the forward direction flows can be supplied to the light emitting element by the voltage applied between the first power supply line and the third power supply line. Therefore no negative power source is required for application of a reverse bias to the light emitting element. Also, the reverse current can be supplied to the light emitting element without being passed through the forward drive section. Therefore a short-circuit defect in the light emitting element can be removed while avoiding degradation in electrical characteristics of a current control device in the forward drive section or breakdown of the current control device. An enhancement-type MOS transistor such as an amorphous or polycrystalline silicon thin-film transistor can be used as the current control device or the switching device.

In the light emitting element drive circuit and the current-control-type light emitting display of the present invention, it is preferable to supply a fourth voltage lower than the third voltage to the third power supply line instead of the third voltage when the forward current is supplied to the light emitting element. In such a case, a ground voltage for example may be supplied as the fourth voltage to the third power supply line, and the forward current can be supplied from the forward drive section to the light emitting element.

The light emitting element drive circuit and the current-control-type light emitting display of the present invention may further comprise a second switch for establishing a connection between the forward drive section and the light emitting element. In such a case, the forward drive section and the light emitting element can be disconnected from each other at the arbitrary point of time.

In the light emitting element drive circuit and the current-control-type light emitting display of the present invention, it is preferred that each of the first switch and the second switch be exclusively set in the conductive state in relation to the other. In such a case, the forward drive section and the light emitting element can be disconnected from each other by setting the second switch 2 in the shutoff state when the first switch is set in the conductive state to apply a reverse voltage to tile light emitting element.

In the light emitting element drive circuit and the current-control-type light emitting display of the present invention, it is preferred that the first switch and the second switch be alternately set in the conductive state. In such a case, the operation to cause the light emitting element to emit light and the operation to supply a reverse current to the light emitting element can be alternately performed and the life of the light emitting element can be extended.

In the current-drive-type light emitting display in the second aspect of the present invention, the luminance data may be a voltage signal and the forward drive section may include a third switch having a control terminal connected to the gate line, a current control device having a control terminal connected to the data line via the third switch, and a capacitor which holds the potential on the control terminal of the current control device.

In the current-drive-type light emitting display in the second aspect of the present invention, the luminance data may be a current signal and the forward drive section may have a current mirror structure such that the data line is on the reference side and the light emitting element is on the output side.

In the current-drive-type light emitting display in the second aspect of the present invention, the luminance data may be a current signal, the forward drive section may include third and fourth switches each having a control terminal connected to the gate line, a current control device having a control terminal connected to the data line via the third and fourth switches, and a capacitor which holds the potential on the control terminal of the current control device, and a node through which the third and fourth switches are connected in series and a node through which the current control device and the second switch are connected are connected to each other.

In the light emitting element drive circuit and the current-drive-type light emitting display of the present invention, there is no need for a negative power supply for application of a reverse bias voltage to the light emitting element. Therefore the size of the drive circuit or the display can be reduced. Also, a reverse current flowing in a direction opposite to the direction in which the forward current flows can be supplied to the light emitting element without being passed through the forward drive section. Therefore a short-circuit defect in the light emitting element can be removed while avoiding any degradation in electrical characteristics of the current control device in the forward drive section or breakdown of the current control device.

BRIEF DESCRIPTION OF THE DRAWINGS

FIG. 4(*b*) is an electrical equivalent circuit diagram of the light emitting element shown in FIG. 4(*a*);

FIG. 7(*b*) is an electrical equivalent circuit diagram of the light emitting element shown in FIG. 7(*a*);

DETAILED DESCRIPTION OF THE PREFERRED EMBODIMENTS

Figure 1:
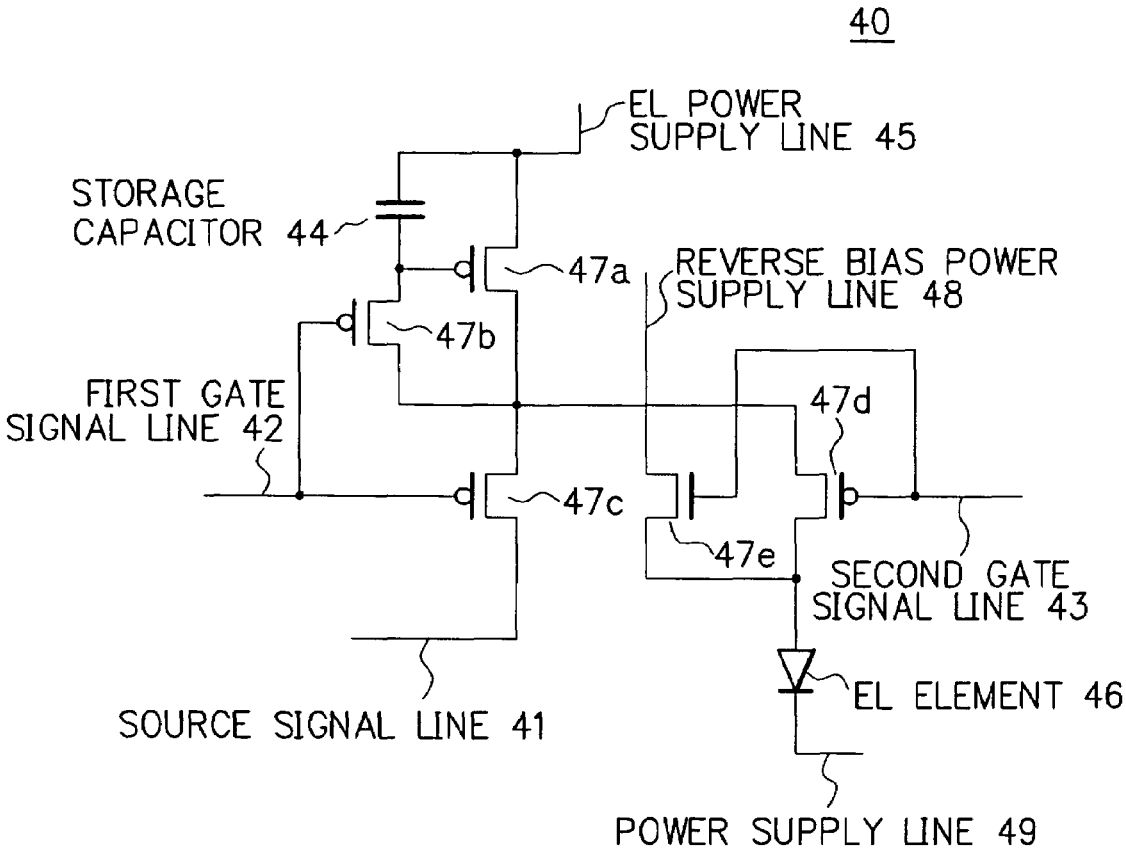
F I G. 1 (PRIOR ART)
FIG. 1 is a circuit diagram showing a portion of an example of a conventional display.
Figure 2:
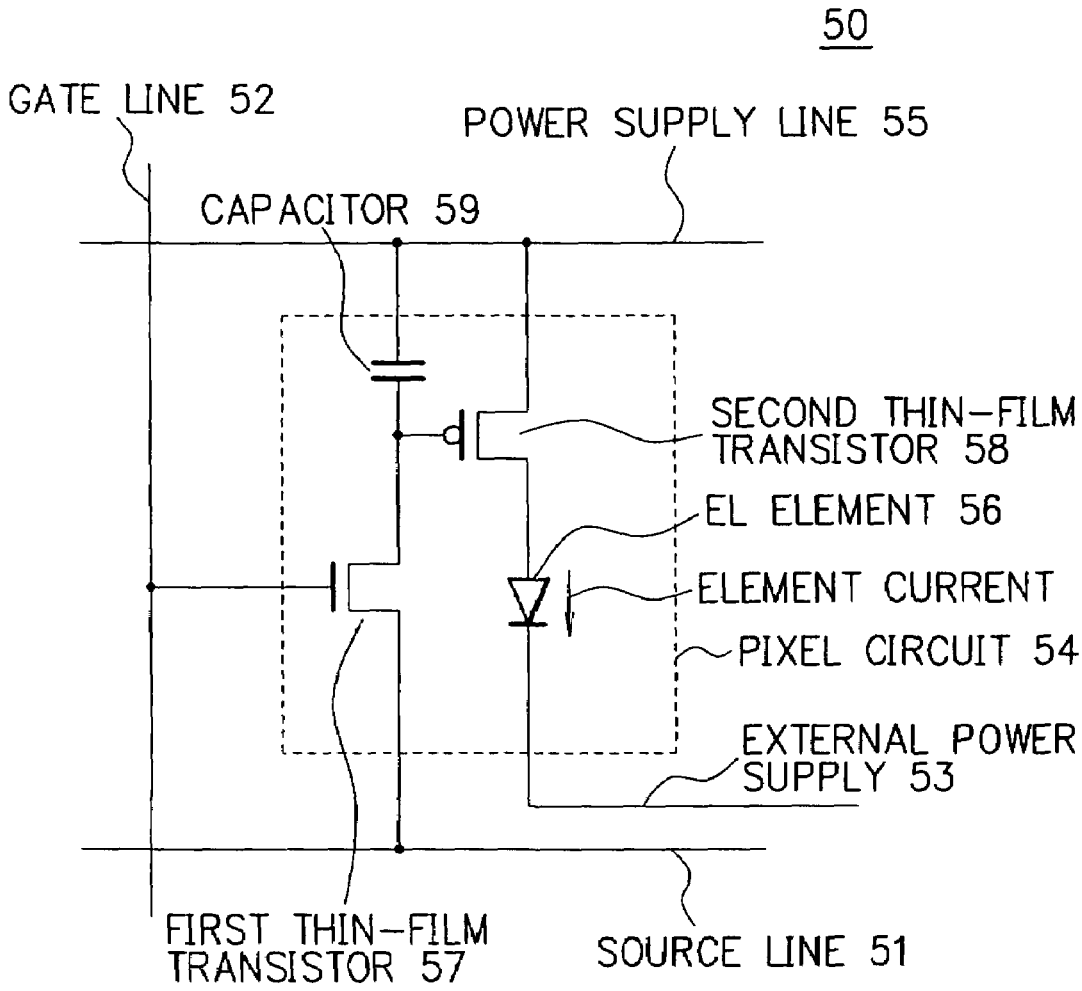
F I G. 2 (PRIOR ART)
FIG. 2 is a circuit diagram showing a pixel circuit of another example of a conventional display.
Figure 3:
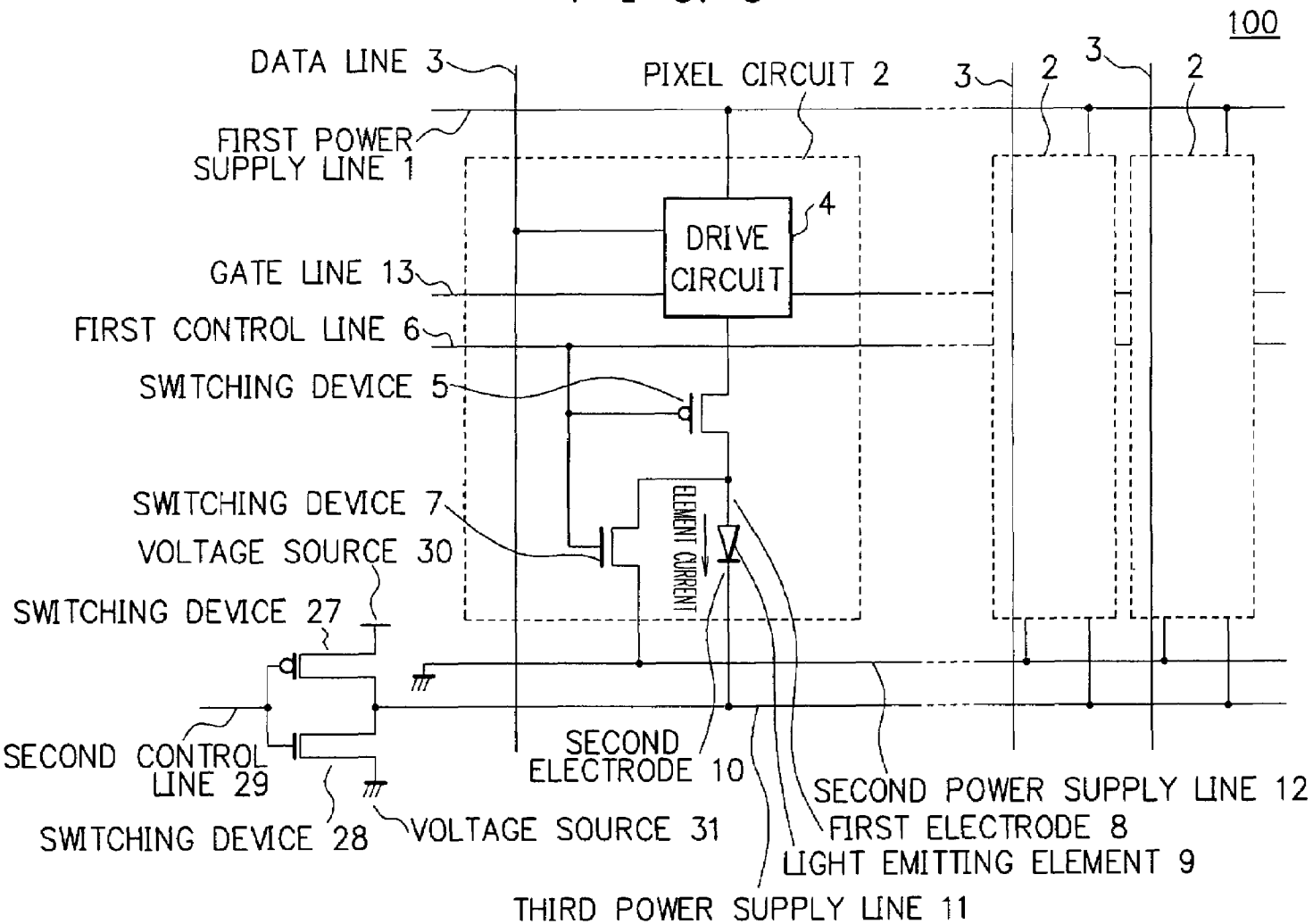
FIG. 3 is a circuit diagram showing a portion of a current-control-type light emitting display in a first embodiment of the present invention.

Referring now to the drawings, a description of preferred embodiments of the present invention will be given in detail. FIG. 3 shows a portion of a current-control-type light emitting display 100 in a first embodiment of the present invention. The display 100 can be used as a display for a portable telephone, a portable information terminal device, a television set, a computer, etc. The display 100 has gate lines 13, data lines 3 and pixel circuits 2 around the respective intersections of the data lines 3 and gate lines 13. While FIG. 3 shows the pixel circuits 2 in one row connected to one gate line 13, actually, a plurality of gate lines 13 are provided in the display 100 and the display 100 has a plurality of pixel circuits 2 arranged in matrix form. It is assumed that a voltage of H level used in the display 100 described below is equal to or higher than a voltage supplied to a first power supply line 1, and that a voltage of L level used in the display 100 is 0 V.

Each pixel circuit 2 has a drive section 4, a first switching device 7, a second switching device 5, and a light emitting element 9. Each pixel circuit 2 is connected to the first power supply line 1, a second power supply line 12, a third power supply line 11, one of the data lines 3, one of the gate lines 13 and a first control line 6. The first power supply line 1 and the second power supply line 12 are connected in common to the respective pixel circuits 2 in the display. The third power supply line 11, the gate line 13 and the first control line 6 are connected in common to all the pixel circuits 2 in one row. The data line 3 is connected in common to all the pixel circuits 2 in one column. Through the first power supply line 1, an arbitrary positive voltage is supplied. Through the second power supply line 12, a ground voltage (0 V) is supplied. Through the third power supply line 11, a voltage supplied from a first voltage source 30 (an arbitrary positive voltage) or the ground voltage (0 V) supplied from a second voltage source 31 is supplied. Determination as to whether an arbitrary positive voltage or 0 V is supplied through the third power supply line 11 is made by a signal supplied from a second control line 29.

The second control line 29 is connected to a control terminal of a third switching device 27 and to a control terminal of a fourth switching device 28. The third switching device 27 and the fourth switching device 28 are connected in series between the first voltage source 30 from which an arbitrary positive voltage is supplied and the second voltage source 31 from which a voltage of 0 V is supplied, and an intermediate node between the third switching device 27 and the fourth switching device 28 is connected to the third power supply line 11. The state of each of the third switching device 27 and the fourth switching device 28 between conductive and shut-off states is controlled by the signal supplied to the second control line 29. The third switching device 27 is formed of, for example, a p-MOS transistor having a gate used as a control terminal, while the fourth switching device 28 is formed of, for example, an n-MOS transistor having a gate used as a control terminal. Each of the third switching device 27 and the fourth switching device 28 is exclusively set in the conductive state in relation to the other, and the third power supply line 11 is selectively connected to the first voltage source 30 or the second voltage source 31 on the basis of the signal supplied to the second control line 29.

To each data line 3, a data signal according to a luminance or brightness at which the light emitting element 9 in a corresponding picture element (pixel) should emit light is supplied. The data signal supplied to the data line 3 is formed as a current signal or a voltage signal. Determination as to whether the data signal is formed as a current signal or a voltage signal is based on circuitry adopted for the drive section 4. A voltage signal in pulse form which periodically becomes H level only during a predetermined period is supplied to each gate line 13. To each of the light emitting elements 9 in the pixel circuits 2 connected to the same gate line 13, a current according to the data signal supplied to the corresponding data line 3 is supplied from the corresponding drive section 4 during the gate line 13 H-level period.

The first control line 6 is connected to a control terminal of the second switching device 5 and to a control terminal of the first switching device 7. The second switching device 5 establishes a connection between the drive section 4 and the light emitting element 9, while the first switching device 7 establishes a connection between the second power supply line 12 and an intermediate node between the second switching device 5 and the light emitting device 9. The state of each of the second switching device 5 and the first switching device 7 between conductive and shutoff state is controlled by the signal supplied to the first control line 6. The second switching device 5 is formed of, for example, a p-MOS transistor, while the first switching device 7 is formed of, for example, an n-MOS transistor. Each of the second switching device 5 and the first switching device 7 is exclusively set in the conductive state in relation to the other. When one of the second switching device 5 and the first switching device 7 is in the conductive state, the other is in the shutoff state.

The drive section 4 is connected to the first power supply line 1, the data line 3, the gate line 13 and the current path in the second switching device 5. The drive section 4 has a current control transistor for controlling the element current flowing through the light emitting element 9. The drive section 4 generates a current according to the data signal supplied to the data line 3 for the period during which the H-level signal is supplied to the gate line 13, and outputs the generated current to the light emitting element 9 from the current control transistor via the second switching device 5. During a period in which a voltage signal of L level is supplied to the gate line 13, the drive section 4 continues outputting the current generated during the immediately preceding H-level period. The periodic voltage signal in pulse form having a predetermined H-level period is supplied to the gate line 13, and the value of the current output from the drive section 4 is periodically updated in correspondence with the gate line 13 H-level period.

The light emitting element 9 is formed as an organic EL element and emits light at the luminance according to the element current. A first electrode 8 of the light emitting element 9 is connected to the drive section 4 via the second switching device 5 and to the second power supply line 12 via the first switching device 7. A second electrode 10 of the light emitting element 9 is connected to the third power supply line 11. A state in which the voltage on the first electrode 8 is higher than that at the second electrode 10 in the light emitting element 9 will be referred to as a forward bias, and a current flowing in the direction from the first electrode 8 to the second electrode 10 through the light emitting element 9 will be referred to as forward current. Conversely, a state in which the voltage on the second electrode 10 is higher than that at the first electrode 8 will be referred to as a reverse bias, and a current flowing in the direction from the second electrode 10 to the first electrode 8 will be referred to as reverse current.

Figure 4:
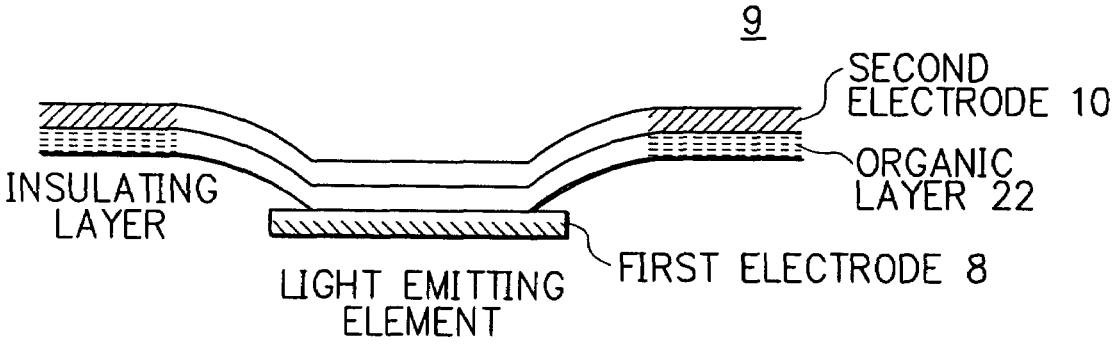
FIG. 4(*a*) is a schematic cross-sectional view of the structure of a light emitting element.
Figure 4:
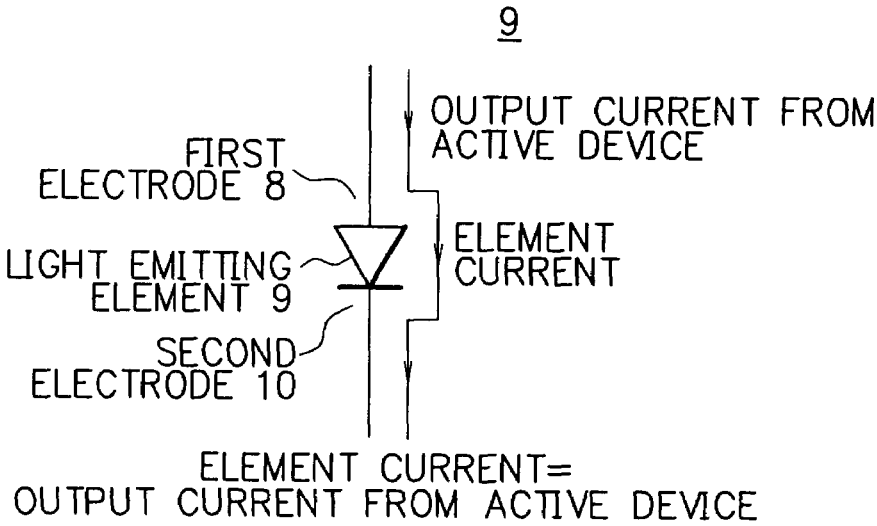
Figure 5:
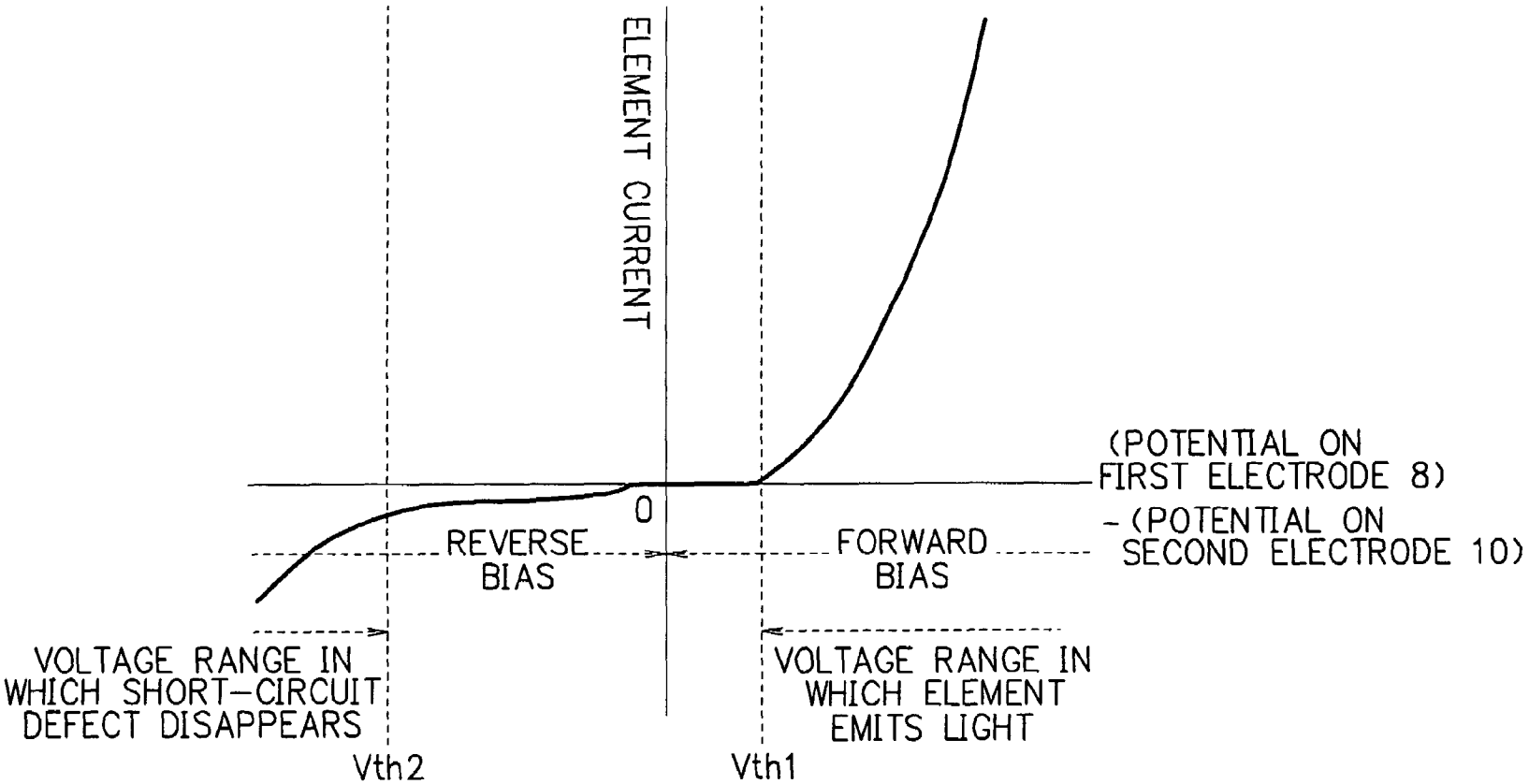
FIG. 5 is a graph showing a current-voltage characteristic of the light emitting element.

FIG. 4(*a*) is a cross-sectional view of each light emitting element 9, and FIG. 4(*b*) is an equivalent circuit diagram of the light emitting element 9. The light emitting element 9 has an organic layer 22 interposed between the first electrode 8 and the second electrode 10. The equivalent circuit of the light emitting element 9 in an ordinary state can be expressed as a diode as shown in FIG. 4(*b*). FIG. 5 shows a current-voltage characteristic of the light emitting element 9. When the forward voltage applied to the light emitting element 9 exceeds a threshold voltage Vth1, a current flows through the light emitting element 9. In the case where the light emitting element 9 has no short-circuit defect, the whole of the forward current supplied from the drive section 4 via the second switching device 5 flows through the light emitting element 9, and the light emitting element 9 emits light at the luminance according to the value of the supplied forward current.

Figure 6:
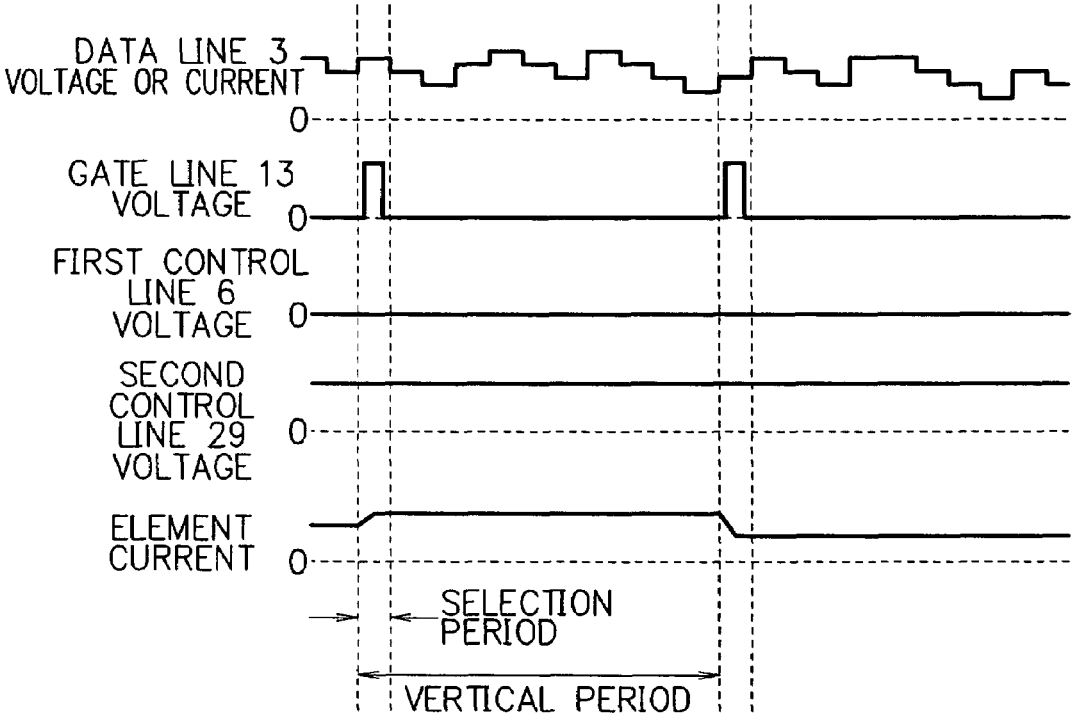
FIG. 6 is a timing chart showing the waveforms of signals applied to certain portions when the light emitting element is caused to emit light at the luminance according to gray level data.

FIG. 6 shows in a timing chart the waveforms of signals applied to certain points when each light emitting element is caused to emit light at the luminance according to gray level data. To the data lines 3, current signals or voltage signals which are changed according to gray levels to be displayed by the pixels are supplied as data signals. A voltage signal in pulse form which is H level during a selection period or a time period shorter than the selection period and which is L level in other periods is supplied to the gate line 13 connected to the pixel circuit 2 of one of the pixels. The selection period is a time period during which the data signal for a gray level to be displayed by one of the pixels is supplied. The voltage signal supplied to the gate line 13 rises in pulse form one time in one vertical period, which is the time period from the beginning of the selection period to the beginning of the next selection period. The drive section 4 generates a current according to the data signal supplied to the data line 3 during the gate line 13 H-level period and continuously outputs the generated current to the second switching device 5 until the next rise to H level on the gate line 13.

When one light emitting element 9 is caused to emit light according to gray level data, the L-level voltage signal is supplied to the first control line 6 and the H-level voltage signal is supplied to the second control line 29. In the pixel circuit 2, the second switching device 5 and the first switching device 7 are set in the conductive state and in the shutoff state, respectively, based on the first control line 6 of the L level. The light emitting element 9 is connected to the drive section 4 via the second switching device 5. On the other hand, the third switching device 27 and the fourth switching device 28 are set in the shutoff state and in the conductive state, respectively, based on the second control line 29 of the H level to connect the third power supply line 11 to the voltage source 31 from which 0 V is supplied. The potential on the second electrode 10 of the light emitting element 9 is thereby set to 0 V. At this time, since the second switching device 5 is in the shutoff state, the current output from the drive section 4 flows to the third power supply line 11 via the second switching device 5 and the light emitting element 9. Thus, the current output from the drive section 4 according to the data signal supplied to the data line 3 during the gate line 13 H-level period is supplied to the light emitting element 9 and the light emitting element 9 emits light at the luminance according to the level of the supplied current.

Figure 7:
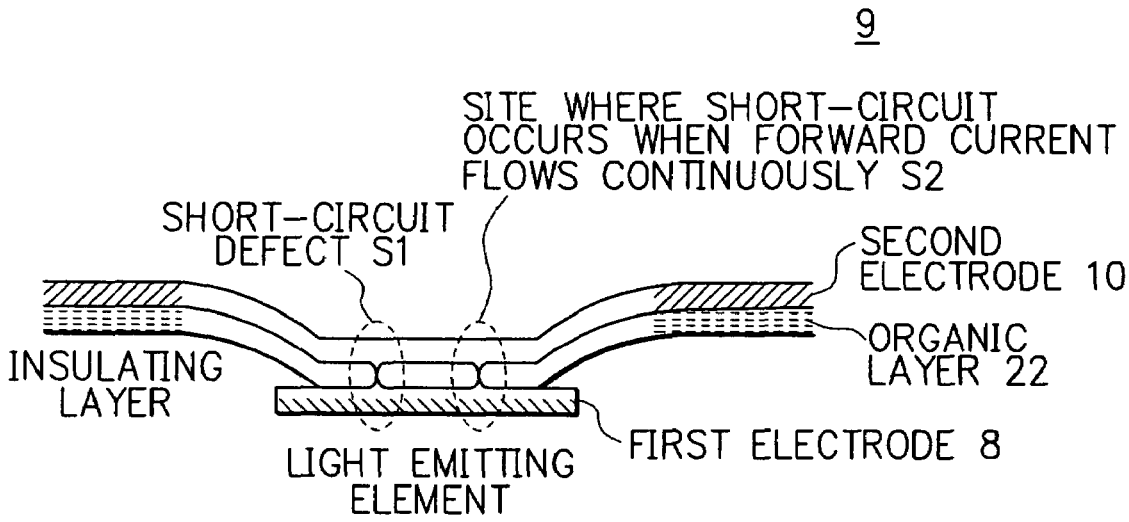
FIG. 7(*a*) is a schematic cross-sectional view of the structure of a light emitting element having a defect caused therein.
Figure 7:
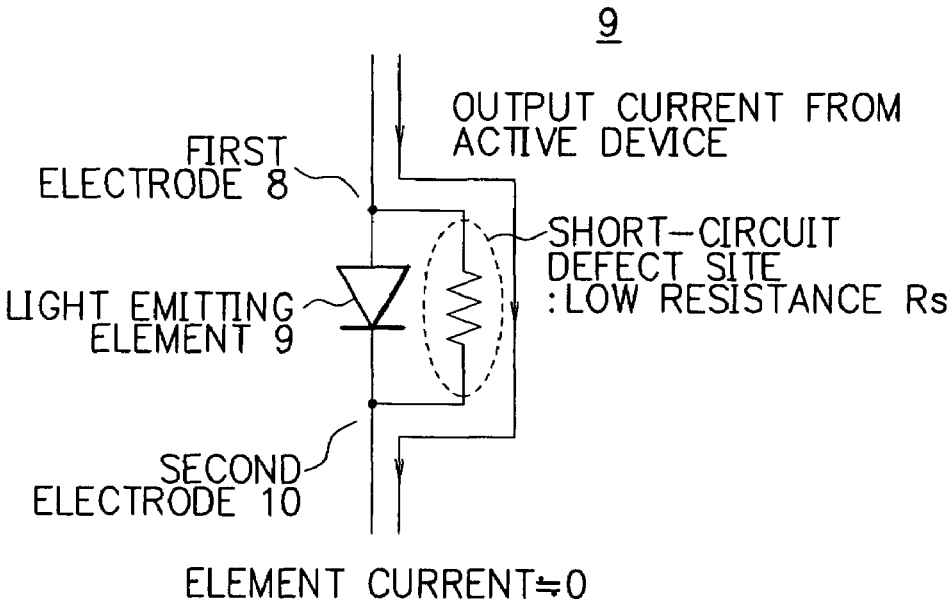

FIG. 7(*a*) shows a sectional view of the light emitting element 9 having a defect caused therein, and FIG. 7(*b*) shows an equivalent circuit of the light emitting element 9. In the example shown in FIG. 7(*a*), after the organic layer 22 has been formed, the light emitting element 9 has, between the first electrode 8 and the second electrode 10, a site (S1) where a short-circuit defect exists and a site (S2) where a short-circuit defect can occur when a forward current flows continuously. In a case where one light emitting element 9 has a short-circuit defect, the equivalent circuit diagram of the light emitting element 9 can be expressed as a combination of a diode and a resistor Rs of a low resistance value connected in parallel with the diode, as shown in FIG. 7(*b*).

In a case where one light emitting element 9 has a short-circuit defect, the current supplied from the drive section 4 via the second switching device 5 flows through the low-resistance resistor Rs and the element current is substantially zero. In this case, therefore, the light emitting element 9 does not emit light according to the gray level at which light is to be emitted, resulting in emission failure. The cause of such an emission failure can be removed in such a manner that a reverse voltage exceeding a threshold value Vth2 shown in FIG. 5 is applied to the light emitting element 9 to cause a sufficiently large reverse current, and short-circuit site is thereby insulated. Also, if the light emitting element 9 has a site (S2) where there is a possibility of occurrence of a short circuit when the forward current flows continuously, a reverse current may be caused to flow through the light emitting element 9 to insulate the site (S2) where there is a possibility of occurrence of a short circuit, thus preventing occurrence of a short circuit.

Figure 8:
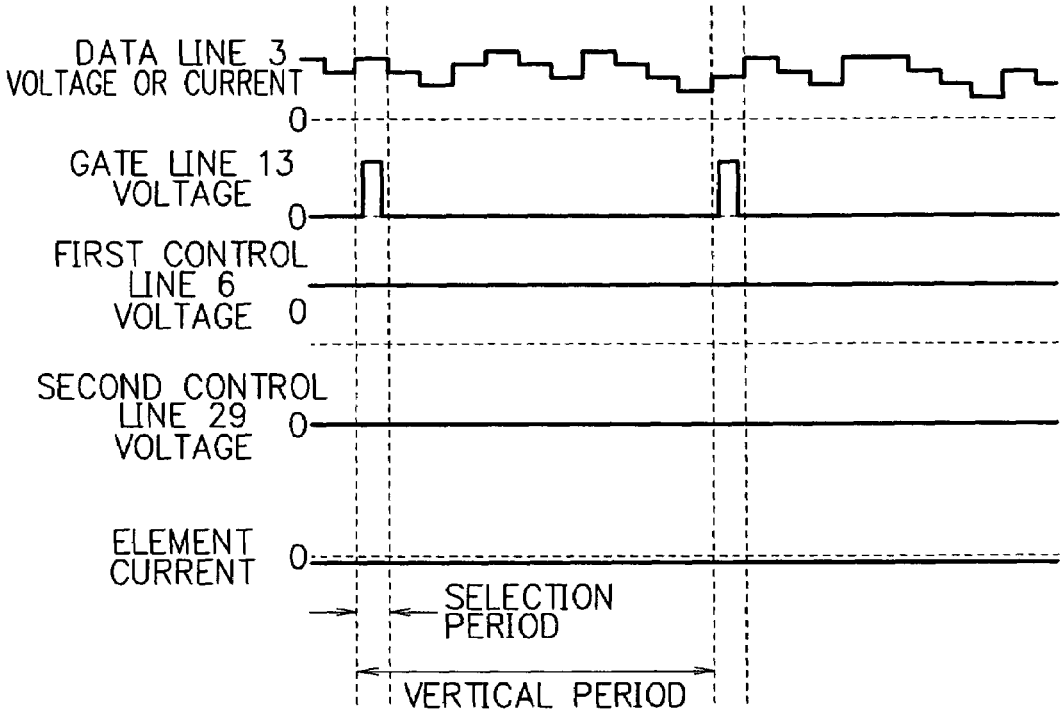
FIG. 8 is a timing chart showing the waveform of signals applied to certain portions when a reverse bias voltage is applied to the light emitting element.

FIG. 8 shows in a timing chart the waveforms of signals applied to certain points when a reverse bias voltage is applied to the light emitting element 9. The signals shown in FIG. 8 are applied to each point when normal image display is not performed, for example, in the process of testing the current-drive-type light emitting display. The signals supplied to the data line 3 and the gate line 13 may be the same as the signals shown in FIG. 6 for emission of light from the light emitting element 9. When a reverse bias voltage is applied to the light emitting element 9, the H-level voltage signal is supplied to the first control line 6 and the L-level voltage signals is supplied to the second control line 29.

In the pixel circuit 2, the second switching device 5 and the first switching device 7 are set in the shutoff state and in the conductive state, respectively, based on the H-level signal on the first control line 6. Since the second switching device 5 is in the shutoff state, the current output from the drive section 4 is not supplied to the light emitting element 9, and the first electrode 8 of the light emitting element 9 is connected via the first switching device 7 in the conductive state to the second power supply line 12 from which 0 V is supplied. On the other hand, the third switching device 27 and the fourth switching device 28 are set in the conductive state and in the shutoff state, respectively, based on the L-level signal on the second control line 29. The third power supply line 11 is thereby connected to the voltage source 30 from which an arbitrary positive voltage is supplied. That is, the voltage applied to the first electrode 8 of the light emitting element 9 becomes 0 V and the voltage applied to the second electrode 10 becomes an arbitrary positive voltage. Consequently, a voltage opposite in polarity to the voltage generated between the first electrode 8 and the second electrode 10 at the time of lighting, i.e., a reverse bias voltage, is applied to the light emitting element 9. When a reverse bias voltage exceeding the threshold value Vth2 (FIG. 5) is applied in a case where a short-circuit defect exists in the light emitting element 9, a sufficiently large reverse current is caused to flow through the light emitting element 9 to remove the short-circuit defect existing in the light emitting element 9.

In this embodiment, as described above, when the first electrode 8 of the light emitting element 9 is connected via the first switching device 7 to the second power supply line 12 from which 0 V is supplied, the third power supply line 11 connected to the second electrode 10 of the light emitting element is connected via the third switching device 27 to the first voltage source 30 from which an arbitrary positive voltage is supplied, thereby applying a reverse bias voltage to the light emitting element 9. By applying a reverse bias voltage to the respective light emitting elements 9, short-circuit defects in the light emitting elements 9 can be reduced to obtain a current-control-type light emitting display having high productivity. In this embodiment, since a reverse bias voltage can be applied to light emitting elements 9 without using a negative power supply, the size, power consumption and manufacturing cost of the current-control-type light emitting display can be reduced. At the time of inspection of the display 100, no device for applying a reverse bias voltage to light emitting elements 9 is required outside the current-control-type light emitting display. Therefore the testing process can be simplified and the inspection time can be reduced.

Also, in this embodiment, a reverse current is supplied to each light emitting element 9 without being passed through the current control transistor that controls the current at the time of light emission. Therefore the value of the reverse current supplied to the light emitting element 9 is not limited by the current control transistor in the drive circuit 4. In this embodiment, when a short-circuit defect in one light emitting element 9 is removed, an event in which a large reverse current flows through the current control transistor in the drive section 4 can be avoided. Therefore a current-control-type light emitting display having improved reliability can be obtained.

Figure 9:
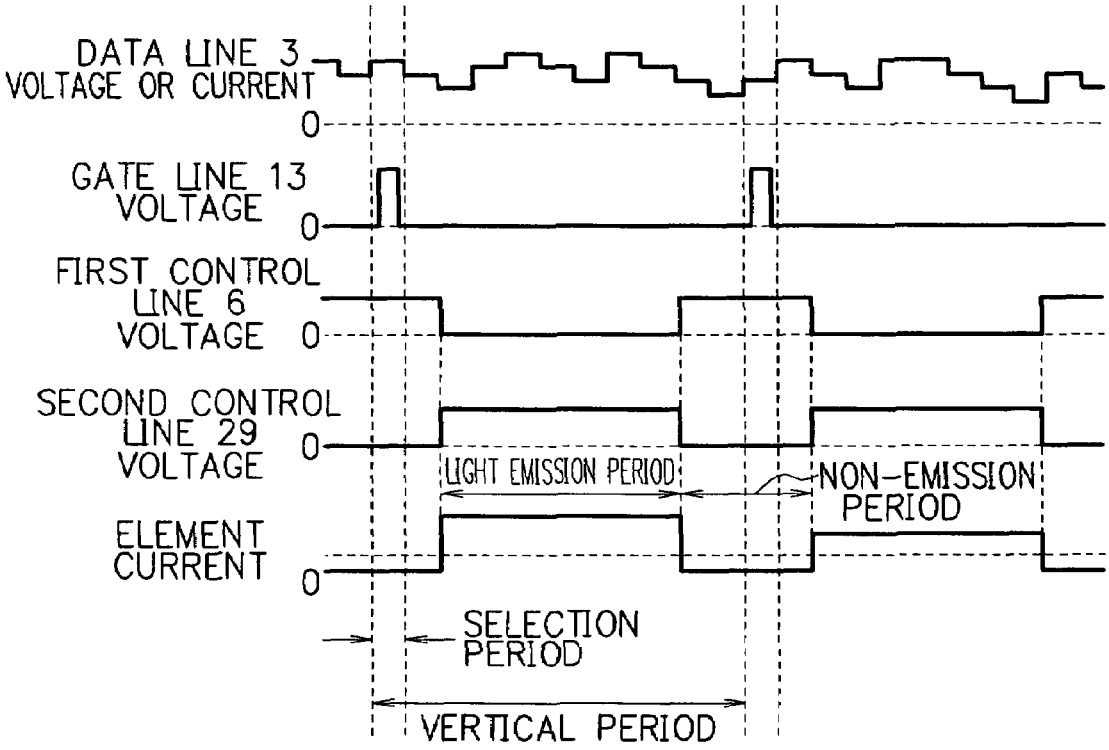
FIG. 9 is a timing chart showing the waveform of signals applied to certain portions when a reverse bias voltage is applied in a time period during which the light emitting element does not emit light.

This embodiment has been described with respect to a case where the operation to cause the light emitting elements 9 to emit light (FIG. 6) and the operation to apply a reverse bias voltage (FIG. 8) are performed separately from each other. However, it is not necessary to separate these operations. The display 100 may operate in such a manner that one vertical period is divided into a light emission period and a non-emission period, the same signals as those shown in FIG. 6 are applied to the portions of the display 100 to cause each light emitting element 9 to emit light, and the same signals as those shown in FIG. 8 are applied to the portions of the display 100 to apply a reverse bias to the light emitting element 9. FIG. 9 shows in a timing chart the waveforms of signals applied to the portions of the display 100 when a reverse bias voltage is applied in the non-emission period in which one light emitting element 9 does not emit light. In the example shown in FIG. 9, the non-emission period is the time period corresponding to the first control line 6 H-level period (second control line 29 L-level period) including the selection period and defined between points in time before and after the selection period, and the light emission period is the time period corresponding to the first control line 6 L-level period (second control line 29 H-level period).

The same signals as those shown in FIG. 6 for emission of light from each light emitting element 9 are supplied to the data line 3 and the gate line 13, and the drive section 4 outputs a current of a current value according to the data signal supplied to the data line 3 during the gate line 13 H-level period. During the light emission period in which the L-level voltage signal is supplied to the first control line 6 and the H-level voltage signal is supplied to the second control line 29, the first electrode 8 of the light emitting element 9 is connected to the drive section 4, as it is at the time of light emission shown in FIG. 6. Also during this period, the second electrode 10 is connected to the third power supply line 11 connected to the second power supply line 31 from which 0 V is supplied. The current according to the signal supplied to the data line 3 in the immediately preceding selection period is supplied to the light emitting element 9 via the second switching device 5 in the conductive stale, thereby causing the light emitting element 9 to emit light.

During the non-emission period in which the H-level voltage signal is supplied to the first control line 6 and the L-level voltage signal is supplied to the second control line 29, as when a reverse bias voltage is applied as shown in FIG. 8, the current output from the drive section 4 is shut off by the second switching device 5 in the shutoff state. During this period, therefore, the light emitting element 9 does not emit light. Also, the first electrode 8 of the light emitting element 9 is connected via the first switching device 7 in the conductive state to the second power supply line 12 from which 0 V is supplied, and the second electrode 10 is connected to the third power supply line 11 connected to the first power supply 30 from which an arbitrary positive voltage is supplied. A reverse bias voltage is thereby applied to the light emitting element 9 to cause a reverse current to flow through the light emitting element 9.

In the above-described example, the operation to cause the light emitting elements 9 to emit light and the operation to apply a reverse bias voltage to the light emitting elements 9 are alternately performed repeatedly for displaying images in the display 100. This method ensures that degradation in characteristics of the light emitting elements 9 can be avoided while images are being displayed, and that the life of the current-control-type light emitting display can be extended. If a construction is adopted in which the same signals as those shown in FIG. 9 are applied to the portions of the display 100 in a testing process, testing of the display condition of the display 100 and the operation to remove a short-circuit defect can be simultaneously performed. In this way, the testing process can be further simplified and the testing time can be reduced.

Figure 10:
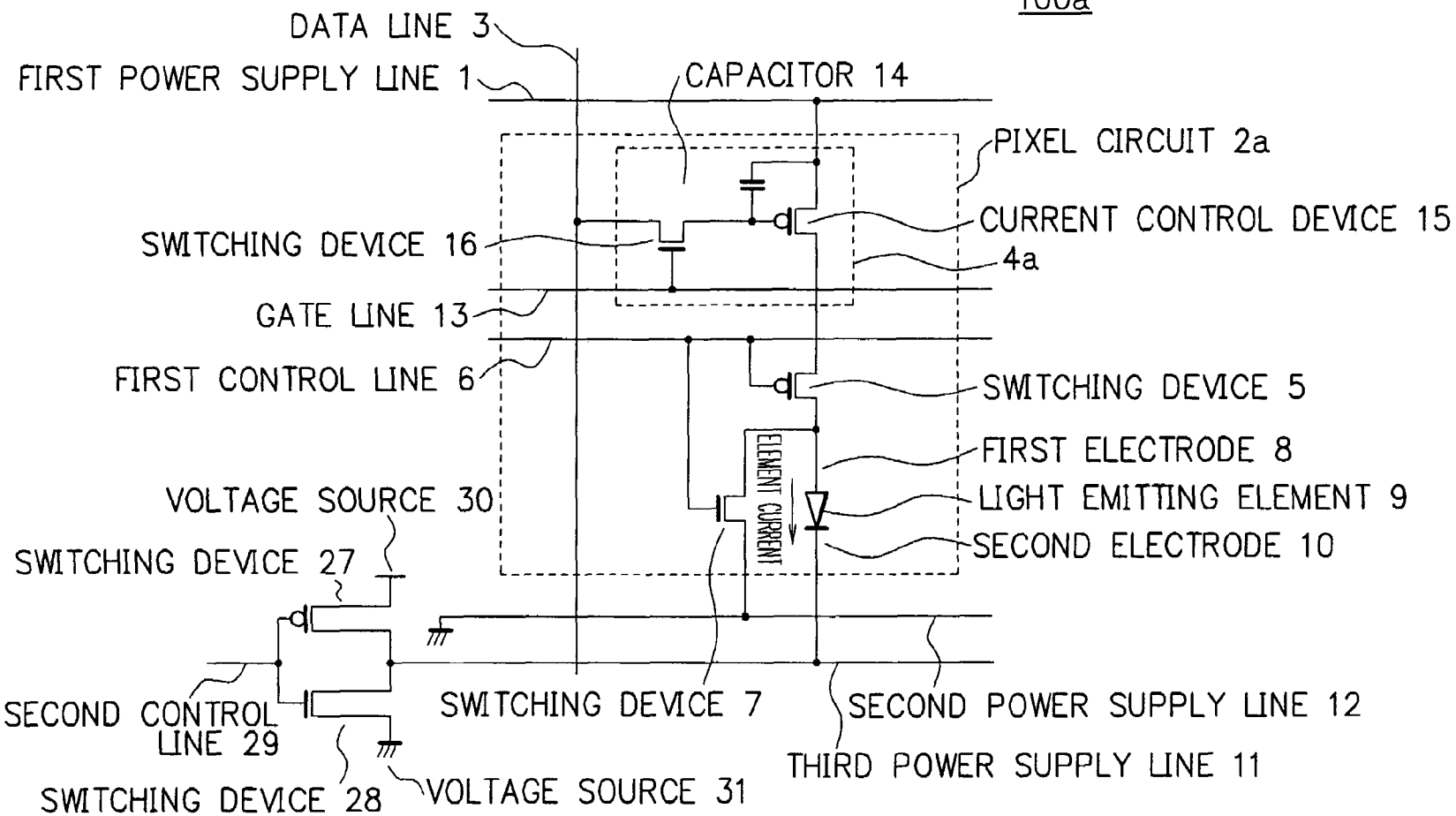
FIG. 10 is a circuit diagram showing the configuration of a current-drive-type light emitting display in a second embodiment of the present invention.

FIG. 10 shows the configuration of a current-drive-type light emitting display in a second embodiment of the present invention. The circuit diagram of FIG. 10 shows only one pixel circuit 2 corresponding to one of the plurality of pixel circuits shown in FIG. 3. In the display 100*a* of this embodiment, a drive section 4*a* corresponding to the drive section 4 shown in FIG. 3 is comprises a capacitor 14, a current control device 15 and a fifth switching device 16, and a voltage signal is supplied to the data line 3. In the drive section 4*a*, the current control device (current control transistor) 15 is connected between the first power supply line 1 and the second switching device 5. A control terminal (gate) of the current control device 15 is connected to the first power supply line 1 via the capacitor 14 and to the data line 3 via the fifth switching device 16. A control terminal of the fifth switching device 16 is connected to the gate line 13.

In the display 100*a* of this embodiment, signals applied to portions of the display at the time of light emission from light emitting elements 9 are the same as those shown in FIG. 6 applied to the portions of the display 100 of the first embodiment. To the data line 3, a voltage signal is applied as a data signal according to a gray level to be displayed by the pixel. During periods other than the selection period, a voltage signal of L level is supplied to the gate line 13 to set the fifth switching device 16 in the shutoff state, thereby disconnecting the data line 3 and the control terminal of the current control device 15. When a voltage signal of H level is supplied to the gate line 13 in the selection period, the fifth switching device 16 is set in the conductive state to connect the data line 3 and the control terminal of the current control device 15. The current control device 15 outputs to the second switching device 5 a current which is input to the control terminal and which has a value according to the voltage level of the data signal supplied to the data line 3.

The voltage signal input from the data line 3 to the current control device 15 is held by the capacitor 14 to enable the current control device 15 to output, to the second switching device 5, even after the voltage on the gate line 13 has become L level, the current having the value according to the data signal supplied to the data line 3 during the immediately preceding gate line 13 H-level period until the voltage on the gate line 13 again becomes H level.

When the light emitting element 9 is caused to emit light, a voltage signal of L level is supplied to the first control line 6 and a voltage signal of H level is supplied to the second control line. At this time, the first electrode 8 of the light emitting element 9 is connected to the drive section 4*a* via the second switching device 5 in the conductive state, and the second electrode 10 is connected via the fourth switching device 28 in the conductive state to the second voltage source 31 from which 0 V is supplied. A current output from the drive section 4*a* and having a current value according to the data signal supplied to the data line 3 during the selection period is thereby caused to flow through the light emitting element 9. The light emitting element 9 thereby emits light at the luminance according to the element current.

In the display 100*a* of this embodiment, signals applied to the portions of the display 100*a* at the time of application of a reverse bias voltage to the light emitting element 9 are the same as those shown in FIG. 8 applied to the portions of the display 100 of the first embodiment. When a reverse bias voltage is applied, a signal of H level is supplied to the first control line 6 and a signal of L level is supplied to the second control line 29. The second switching device 5 is thereby set in the shutoff state and no current output from the drive section 4*a* flows through the light emitting element 9. Also, the first electrode 8 of the light emitting element 9 is connected via the first switching device 7 in the conductive state to the second power supply line 12 from which 0 V is supplied, and the second electrode 10 is connected to the third power supply line 11 which is connected to the first voltage source 30 and through which an arbitrary positive voltage is supplied, thereby applying a reverse bias voltage to the light emitting element 9.

In this embodiment, the data signal is formed as a voltage signal, and the drive circuit which supplies the light emitting element 9 with a current according to a gray level to be displayed is formed as a circuit capable of generating a current according to the voltage signal. The display 100*a* operates in the same manner as the display 100 in the first embodiment at the time of light emission from the light emitting element and at the time of reverse bias application. Also in this embodiment, the operation to apply signals such as shown in FIG. 9 to the portions of the display 100*a* to cause the light emitting element 9 to emit light and the operation to apply a reverse bias voltage to the light emitting element 9 may be alternately performed.

Figure 11:
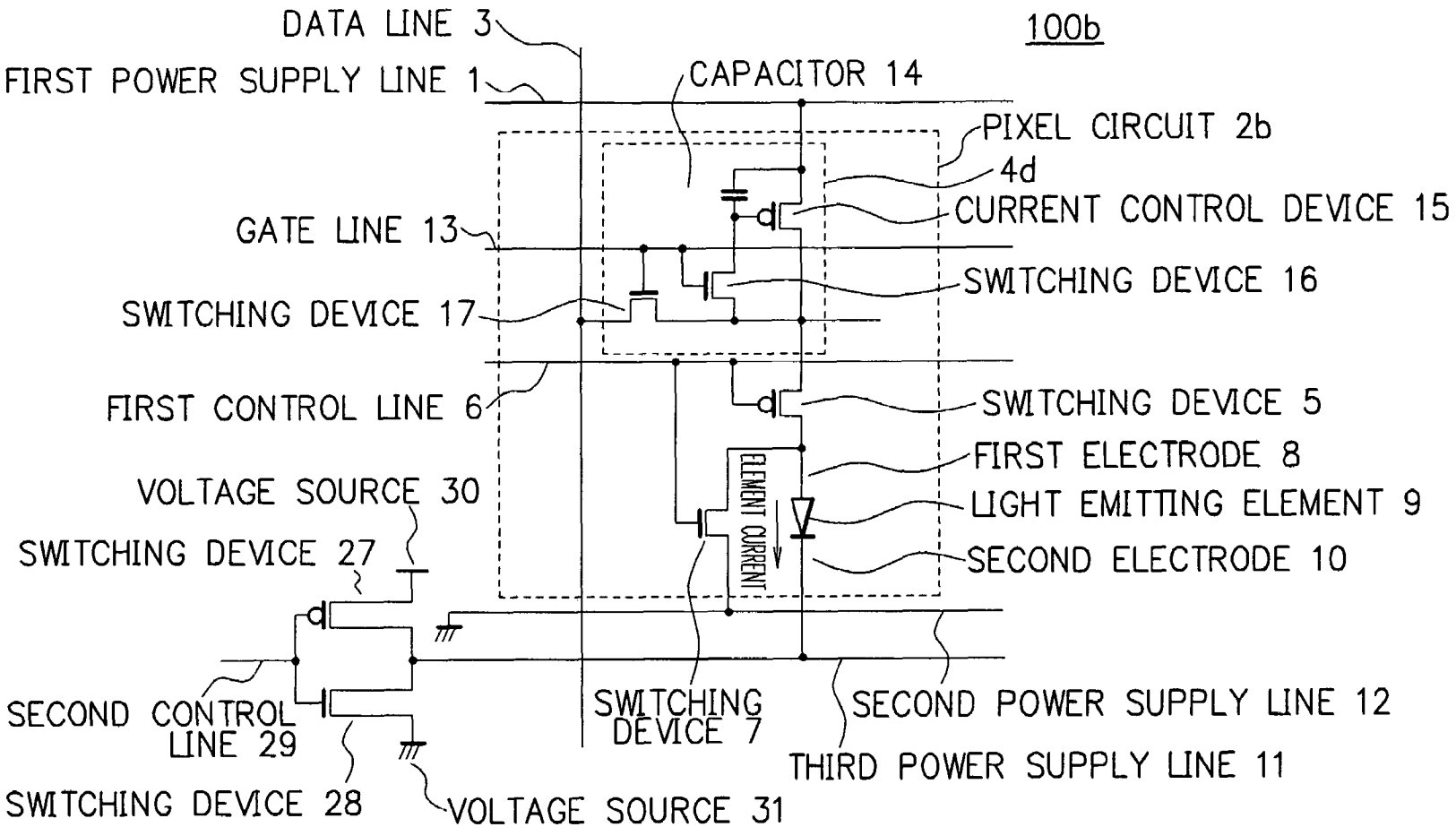
FIG. 11 is a circuit diagram showing the configuration of a current-control-type light emitting display in a third embodiment of the present invention.

FIG. 11 shows the configuration of a current-control-type light emitting display in a third embodiment of the present invention. The circuit diagram of FIG. 11 also shows only one pixel circuit 2, as does the circuit diagram of FIG. 10. In the display 100*b* of this embodiment, a drive section 4*b* corresponding to the drive section 4 shown in FIG. 3 comprises a capacitor 14, a current control device 15, a fifth switching device 16 and a sixth switching device 17, and a current signal is supplied to the data line 3.

In the drive section 4*b*, the current control device 15 is connected between the first power supply line 1 and the second switching device 5, and a control terminal of the current control device 15 is connected to the first power supply line 1 via the capacitor 14. The control terminal of the current control device 15 is further connected to a terminal on the output side of the current control device 15 via the fifth switching device 16, and the fifth switching device 16 is connected to the data line 3 via the sixth switching device 17. Each of a control terminal of the fifth switching device 16 and a control terminal of the sixth switching device 17 is connected to the gate line 13.

Figure 12:
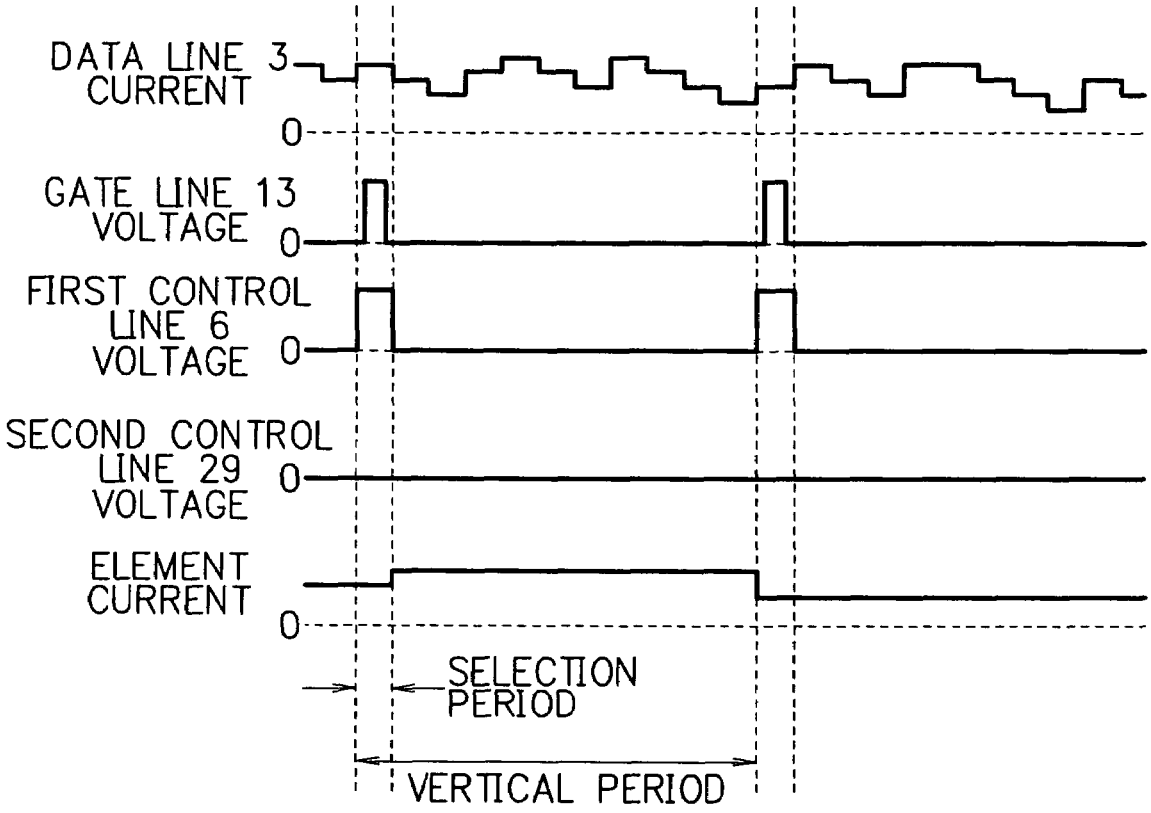
FIG. 12 is a timing chart showing the waveform of signals applied to certain portions when the light emitting element is caused to emit light at the luminance according to gray level data in the display 100*b* shown in FIG. 11.

FIG. 12 shows in a timing chart the waveforms of signals applied to the portions of the display 100*b* when the light emitting element is caused to emit light at the luminance according to gray level data. The waveform diagram of FIG. 12 differs from FIG. 6 in that the signal supplied to the first control line 6 becomes H level in the selection period. To the data line 3, a current signal is supplied as a data signal according to a gray level to be displayed by the light emitting element 9. To the first control line 6, a voltage signal of H level is supplied during the selection period or the gate line 13 H-level period, and a voltage signal of L level is supplied during periods other than the selection period or the gate line 13 H-level period.

During periods other than the selection period, a voltage signal of L level is supplied to the gate line 13 to set the fifth switching device 16 and the sixth switching device 17 in the shutoff state, thereby disconnecting the data line 3, the control terminal of the current control device 15 and one end of the current path. When a voltage signal of H level is supplied to the gate line 13 in the selection period, the fifth switching device 16 and the sixth switching device 17 are set in the conductive state. During the gate line 13 high-level period, the H-level voltage signal is supplied to the first control line 6 to set the second switching device 5 in the shutoff state and, therefore, no current flows from the drive section 4*b* to the light emitting element 9. Consequently, substantially the same current as that supplied to the data line 3 during the gate line 13 H-level period flows through the current control device 15.

When substantially the same current as that supplied to the data line 3 flows through the current control device 15, the potential on the control terminal of the current control device 15 is determined according to the current flowing therethrough. This control terminal potential is held by the capacitor 14 even after the voltage on the gate line 13 has been changed from H level to L level and after the fifth switching device 16 and the sixth switching device 17 have been set in the shutoff state. Therefore, the current control device 15 can output to the second switching device 5 the current having the value substantially equal to the data signal supplied to the data line 3 during the immediately preceding gate line 13 H-level period, even after the voltage on the gate line 13 has become L level.

When the light emitting element 9 is caused to emit light, a voltage signal of H level is supplied to the second control line and the second electrode 10 of the light emitting element 9 is connected to the third power supply line 11 connected to the second voltage source 31 from which 0 V is supplied. When the voltage on the gate line 13 becomes L level and when the voltage on the first control line 6 becomes L level, the second switching device 5 is set in the conductive state and the first electrode 8 of the light emitting element 9 is connected to the drive section 4*b* via the second switching device 5 in the conductive state. A current output from the drive section 4*b* having a current value according to the data signal supplied to the data line 3 during the selection period is thereby caused to flow through the light emitting element 9. The light emitting element 9 thereby emits light at the luminance according to the element current.

In the display 100*b* of this embodiment, signals applied to the portions of the display 100*b* at the time of application of a reverse bias voltage to the light emitting element 9 are the same as those shown in FIG. 8 applied to the portions of the display 100 of the first embodiment. When a reverse bias voltage is applied, a signal of H level is supplied to the first control line 6 and a signal of L level is supplied to the second control line 29. The second switching device 5 is thereby set in the shutoff state and no current output from the drive section 4*b* flows through the light emitting element 9. Also, the first electrode 8 of the light emitting element 9 is connected via the first switching device 7 in the conductive state to the second power supply line 12 from which 0 V is supplied, and the second electrode 10 is connected to the third power supply line 11 which is connected to the first voltage source 30 and through which an arbitrary positive voltage is supplied, thereby applying a reverse bias voltage to the light emitting element 9.

In this embodiment, the data signal is formed as a current signal, and the drive circuit which supplies the light emitting element 9 with a current according to a gray level to be displayed is formed as a circuit capable of generating a current according to the current signal. The display 100*b* operates in the same manner as in the first embodiment at the time of light emission from the light emitting element 9 and at the time of reverse bias application. Also in this embodiment, the operation to apply signals such as shown in FIG. 9 to the portions of the display 100*b* to cause the light emitting element 9 to emit light and the operation to apply a reverse bias voltage to the light emitting element 9 may be alternately performed.

Figure 13:
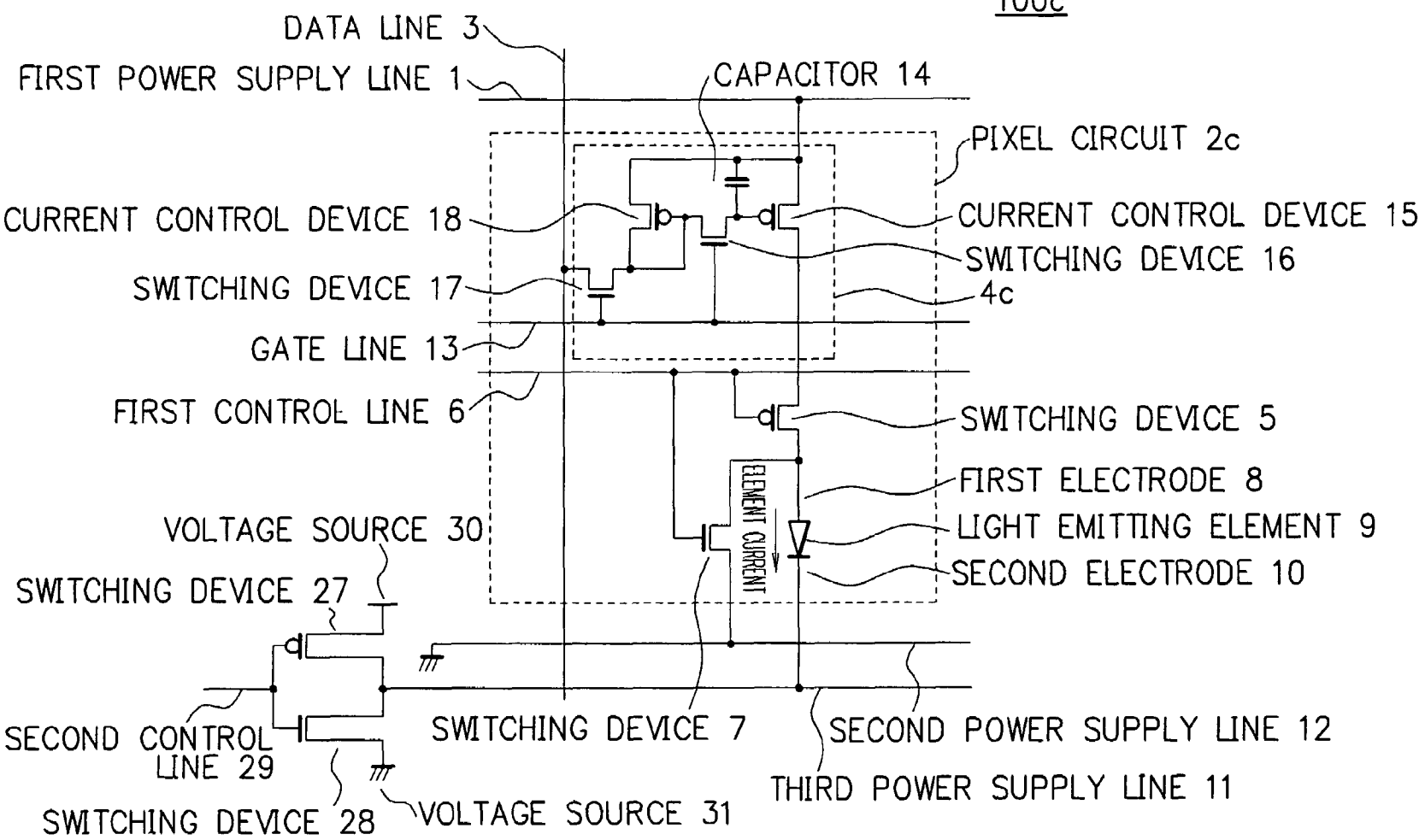
FIG. 13 is a circuit diagram showing the configuration of a current-control-type light emitting display in a fourth embodiment of the present invention.

FIG. 13 shows the configuration of a current-control-type light emitting display in a fourth embodiment of the present invention. The circuit diagram of FIG. 13 also shows only one pixel circuit 2, as does the circuit diagram of FIG. 10. In the display 100*c* of this embodiment, a drive section 4*c* corresponding to the drive section 4 shown in FIG. 3 comprises a capacitor 14, a first current control device 15, a fifth switching device 16, a sixth switching device 17 and a second current control device 18, and a current signal is supplied to the data line 3.

In the drive section 4*c*, the first current control device 15 is connected between the first power supply line 1 and the second switching device 5, and a control terminal of the current control device 15 is connected to the first power supply line 1 via the capacitor 14. One current path in the second current control device 18 is connected to the first power supply line 1, while the other current path is connected to the data line 3 via the sixth switching device 17. A control terminal of the second current control device 18 and the other current path of the second current control device 18 are connected to each other. The fifth switching device 16 establishes a connection between the control terminal of the first current control device 15 and the control terminal of the second current control device 18. Each of a control terminal of the fifth switching device 16 and a control terminal of the sixth switching device 17 is connected to the gate line 13.

In the display 100*c* of this embodiment, signals applied to the portions of the display at the time of light emission from light emitting elements 9 are the same as those shown in FIG. 6 applied to the portions of the display 100 of the first embodiment. To the data line 3, a current signal is supplied as a data signal according to a gray level to be displayed by the pixel. During periods other than the selection period, a voltage signal of L level is supplied to the gate line 13 to set the fifth switching device 16 and the sixth switching device 17 in the shutoff state, and the data line 3 is not connected to the control terminal of the current control device 15 and one end of the current path.

When a voltage signal of H level is supplied to the gate line 13 in the selection period, the fifth switching device 16 and the sixth switching device 17 are set in the conductive state, substantially the same current as that supplied to the data line 3 flows through the second current control device 18, and the potential on the control terminal of the second current control device 18 is determined according to the current flowing therethrough. At this time, the fifth switching device 16 is in the conductive state and, therefore, the first current control device 15 and the second current control device 18 form a current mirror and a current based on the value of the current flowing through the second current control device 18 flows through the first current control device 15. That is, the current according to the value of the current supplied to the data line 3 flows through the first current control device 15. The potential on the control terminal of the first current control device 15 is held by the capacitor 14.

When the voltage on the gate line 13 is changed from H level to L level, the sixth switching device 17 is set in the shutoff state and no current flows through the second current control device 18. Also, the fifth switching device 16 is set in the shutoff state and the control terminal of the first current control device 15 and the control terminal of the second current control device 18 are disconnected from each other. Since the potential on the control terminal of the first current control device 15 is held by the capacitor 14, the current having the value according to the data signal supplied to the data line during the immediately preceding gate line 13 H-level period can be output to the second switching device 5 even after the voltage on the gate line 13 has become L level.

When the light emitting element 9 is caused to emit light, a voltage signal of L level is supplied to the first control line 6 and a voltage signal of H level is supplied to the second control line. At this time, the first electrode 8 of the light emitting element 9 is connected to the drive section 4*c* via the second switching device 5 in the conductive state, and the second electrode 10 is connected to the third power supply line 11 connected via the fourth switching device 28 in the conductive state to the second voltage source 31 from which 0 V is supplied. A current output from the drive section 4*c* and having a current value according to the data signal supplied to the data line 3 during the selection period is thereby caused to flow through the light emitting element 9. The light emitting element 9 thereby emits light at the luminance according to the element current.

In the display 100*c* of this embodiment, signals applied to the portions of the display 100*c* at the time of application of a reverse bias voltage to the light emitting element 9 are the same as those shown in FIG. 8 applied to the portions of the display 100 of the first embodiment. When a reverse bias voltage is applied, a signal of H level is supplied to the first control line 6 and a signal of L level is supplied to the second control line 29. The second switching device 5 is thereby set in the shutoff state and no current output from the drive section 4*c* flows through the light emitting element 9. Also, the first electrode 8 of the light emitting element 9 is connected via the first switching device 7 in the conductive state to the second power supply line 12 from which 0 V is supplied, and the second electrode 10 is connected to the third power supply line 11 which is connected to the first voltage source 30 and through which an arbitrary positive voltage is supplied, thereby applying a reverse bias voltage to the light emitting element 9.

In this embodiment, the data signal is formed as a current signal, and the drive circuit which supplies the light emitting element 9 with a current according to a gray level to be displayed is formed as a current mirror. The display 100*c* operates in the same manner as in the first embodiment at the time of light emission from the light emitting element 9 and at the time of reverse bias application. Also in this embodiment, the operation to apply signals such as shown in FIG. 9 to the portions of the display 100*c* to cause the light emitting element 9 to emit light and the operation to apply a reverse bias voltage to the light emitting element 9 may be alternately performed.

Figure 14:
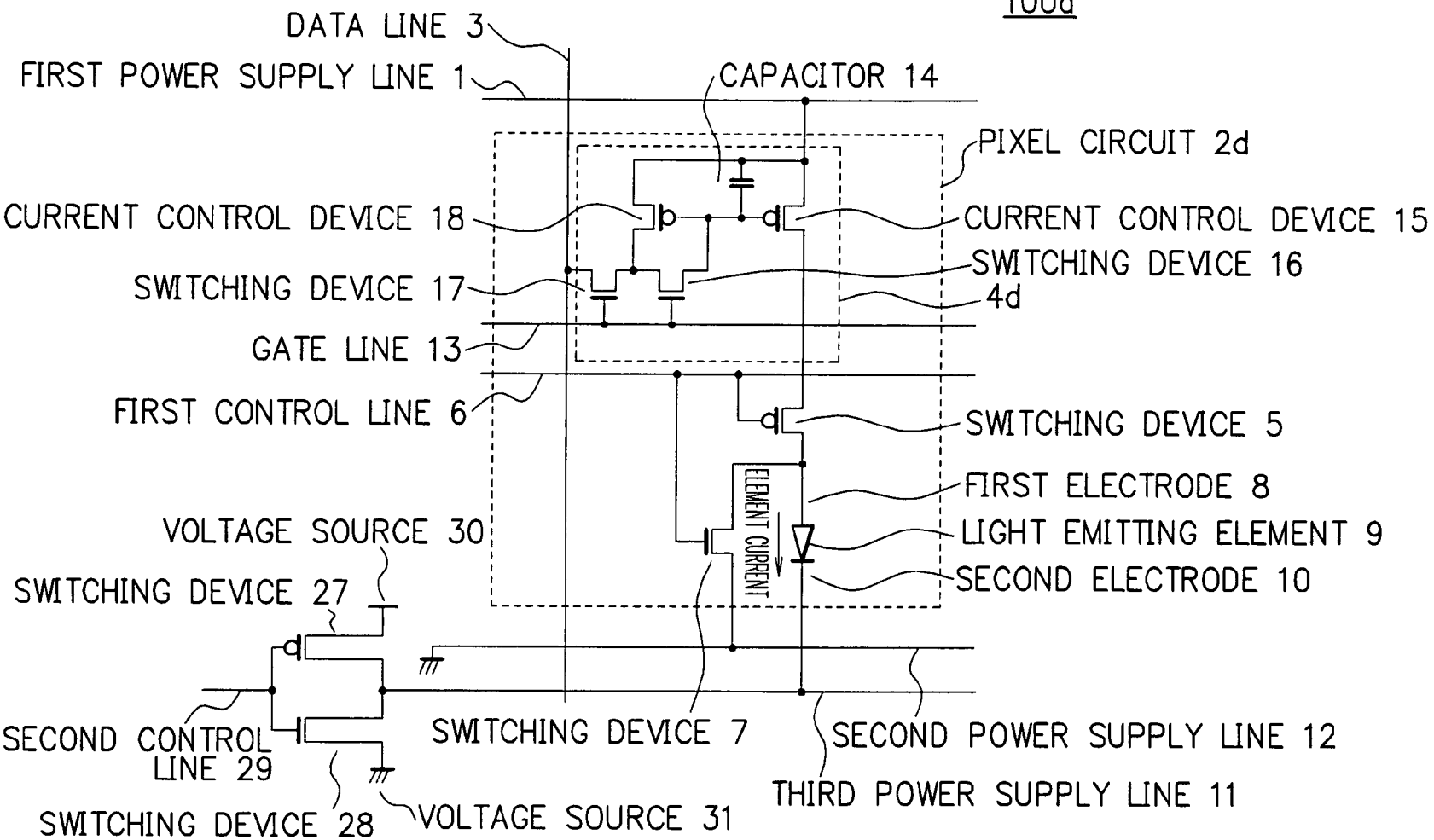
FIG. 14 is a circuit diagram showing the configuration of a current-control-type light emitting display in a fifth embodiment of the present invention.

FIG. 14 shows the configuration of a current-control-type light emitting display in a fifth embodiment of the present invention. The circuit diagram of FIG. 14 also shows only one pixel circuit 2, as does the circuit diagram of FIG. 10. The display 100*d* of this embodiment differs from that of the fourth embodiment in the construction of a drive section 4*d* in comparison with the drive section 4*c* shown in FIG. 13. That is, the fifth switching device 16 is interposed between the control terminals of the second current control device 18 and the seventh switching device 17 side of the current path of the second current control device 18. In the drive section 4*d*, the first current control device 15 and the second current control device 18 form a current mirror when the voltage on the gate line 13 is at H level. In the display 100*d* of this embodiment, therefore, a current of a value according to the current supplied to the data line 3 during the selection period immediately before light emission from the light emitting element 9 can be supplied to the light emitting element 9 at the time of light emission from the light emitting element 9, as in the fourth embodiment.

In this embodiment, the data signal is formed as a current signal, and the drive circuit which supplies the light emitting element 9 with a current according to a gray level to be displayed is formed as a current mirror. The display 100*d* of this embodiment operates in the same manner as in the first embodiment at the time of light emission from the light emitting element and at the time of reverse bias application, and the same effects as those obtained in the first embodiment can be obtained. Also in this embodiment, the operation to apply signals such as shown in FIG. 9 to the portions of the display 100*d* to cause the light emitting element 9 to emit light and the operation to apply a reverse bias voltage to the light emitting element 9 may be alternately performed.

Figure 15:
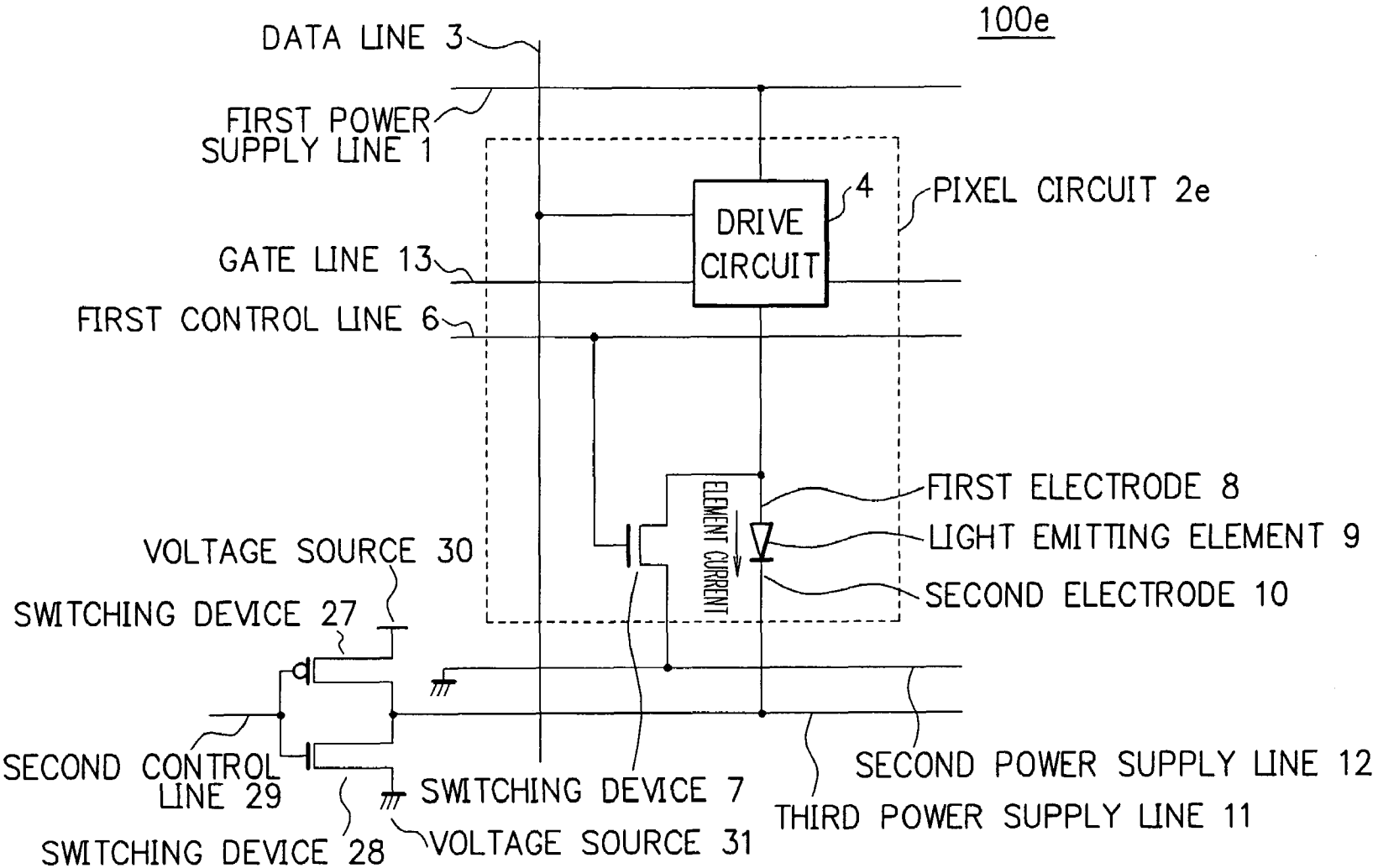
FIG. 15 is a circuit diagram showing the configuration of a current-control-type light emitting display in a sixth embodiment of the present invention.

FIG. 15 shows the configuration of a current-control-type light emitting display in a sixth embodiment of the present invention. The circuit diagram of FIG. 15 also shows only one pixel circuit 2, as does the circuit diagram of FIG. 10. The display 100*c* of this embodiment differs from that of the first embodiment in that the second switching device 5 is not provided between the drive section 4 and the light emitting element 9. The operation of the display 100*e* at the time of light emission from the light emitting element 9 is the same as that in the first embodiment. Also, the operation when a reverse bias is applied to the light emitting element 9 is the same as that in the first embodiment except that the current output from the drive section 4 flows to the second power supply line 12 via the first switching device 7 without being shut off by the switching device.

Also in a case where no switching device is placed between the drive section 4 and the light emitting element 9 as in this embodiment, the display 100*e* operates in the same manner as the display 100 of the first embodiment. In the display 100*e* of this embodiment, the same circuitry as the drive section 4*a* of the second embodiment shown in FIG. 10, the same circuitry as the drive section 4*c* of the fourth embodiment shown in FIG. 13 or the same circuitry as the drive section 4*d* of the fifth embodiment shown in FIG. 14 may be employed for the drive section 4.

Figure 16:
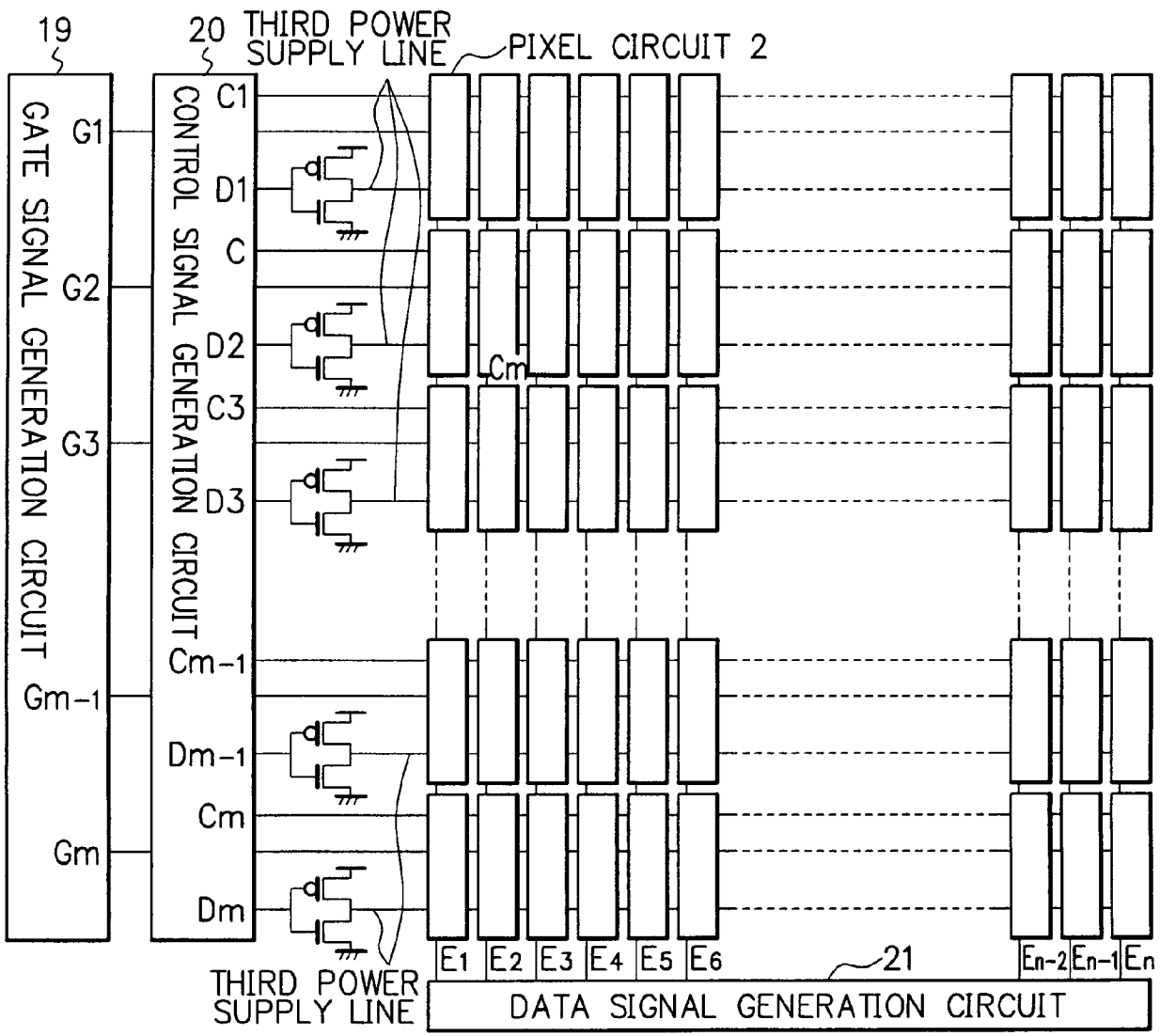
FIG. 16 is a block diagram showing the configuration of a current-drive-type light emitting display having picture elements in m-row×n-column array (where each of m and n is an arbitrary natural number)

FIG. 16 shows the configuration of a current-drive-type display 110 of the present invention having pixels in an m-row×n-column array (where each of m and n is an arbitrary natural number). The display 110 has a gate signal generation circuit 19, a control signal generation circuit 20, a data signal generation circuit 21 and a plurality of pixel circuits 2 arrayed in matrix form. As each pixel circuit 2, one of the pixel circuits of the first to sixth embodiments can be used. In FIG. 16, the first power supply line 1 and the second power supply line 12 are not shown.

The pixel circuits 2 are formed around the respective intersections of m gate lines G1 to Gm and n data lines E1 to En. Each of the gate lines G1 to Gm corresponds to the gate line 13 shown in FIG. 3, and the data lines E1 to En correspond to the data lines 3 shown in FIG. 3. The gate signal generation circuit 19 generates gate signals each formed as a periodic pulse signal which is at H level only during a predetermined period, and outputs the generated gate signals to the gate lines G1 to Gm. The data signal generation circuit 21 generates data signals formed as voltage signals or current signals according to gray levels to be displayed by the pixels, and outputs the generated data signals to the data lines tE1 to En.

Each of first control signal lines C1 to Cm corresponds to the first control line 6 shown in FIG. 3, and each of the second control lines D1 to Dm corresponds to the second control line 29. The control signal generation circuit 20 generates a first control signal output to the first control signal lines C1 to Cm and a second control signal output to the second control lines D1 to Dm. When the light emitting elements 9 are caused to emit light the control signal generation circuit 20 outputs the first control signal of L level to the first control lines C1 to Cm, and outputs the second control signal of H level to the second control signals D1 to Dm. Also, the control signal generation circuit 20 outputs a first control signal of H level to the first control signal lines C1 to Cm and a second control signal of L level to the second control lines D1 to Dm when a reverse bias voltage is applied to the light emitting elements 9.

Figure 17:
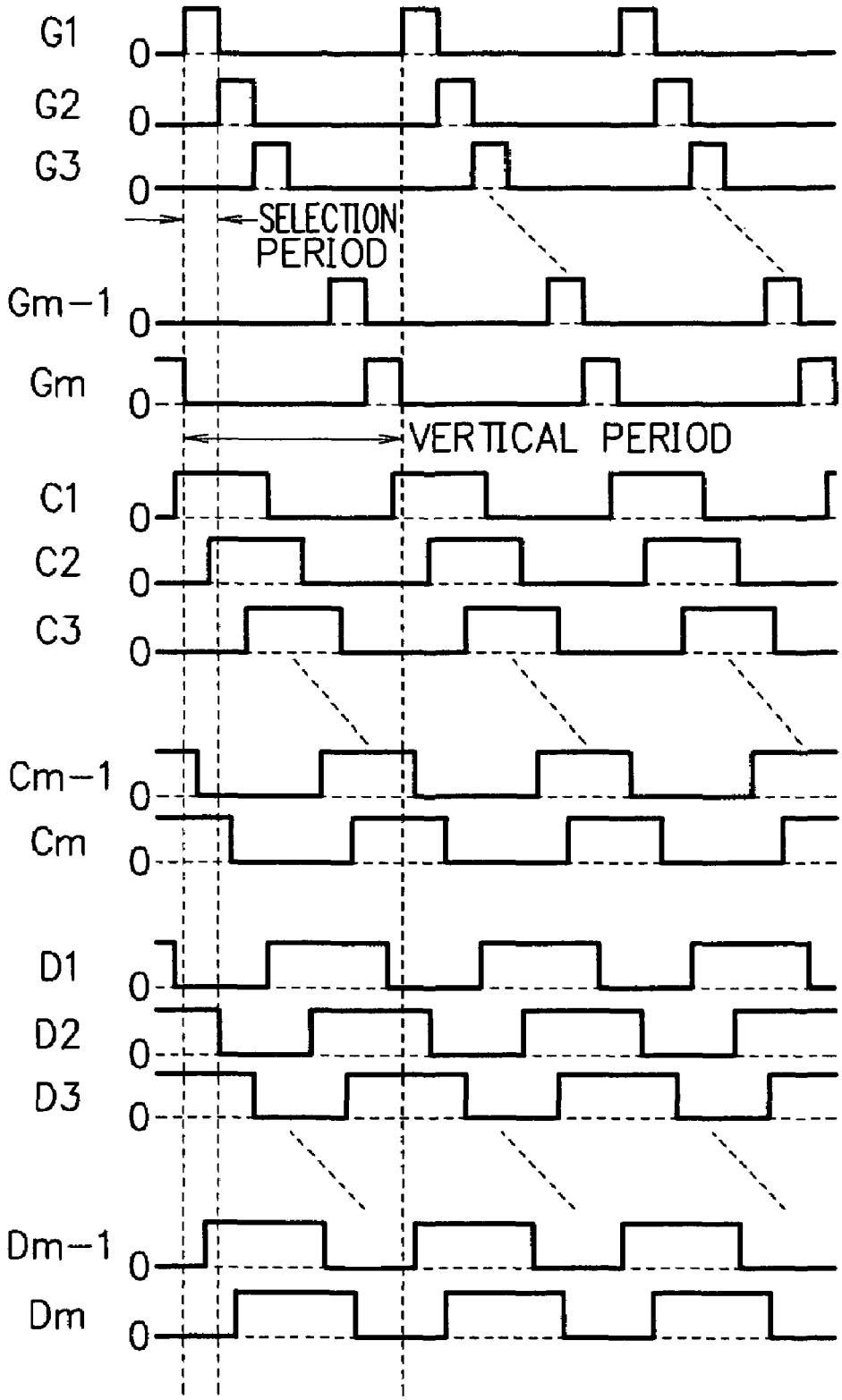
FIG. 17 is a timing chart showing the waveforms of signals applied to portions of the display 100 shown in FIG. 16.

FIG. 17 shows in a timing chart an example of the waveforms of signals applied to the portions of the display 110. The example of the waveforms shown in FIG. 17 is such that the reverse bias voltage is applied in the non-emission period of each light emitting element, as in the case of the example shown in FIG. 9. The gate signal generation circuit 19 outputs to the gate lines G1 to Gm gate signals each of which becomes H level during the selection period or a period shorter than the selection period, and which differ in phase from each other. In the display 110, scanning in the row direction is performed by the gate signals.

The gate signal generation circuit 19 sets the gate signal to be output to the gate line Gi for the ith line ($1 \leqq i \leqq m$) to H level for a time period equal to or shorter than the selection period. Subsequently, the gate signal generation circuit 19 sets the gate signal to be output to the gate line G(i+1) for the (i+1)th line to H level for a time period equal to or shorter than the selection period. When the voltage on the gate line for one row is H level, the voltages on the gate lines for the other rows are L level. In the pixel circuits 2 in one of the rows, the drive sections 4 generate currents according to the data signals supplied to the data lines E1 to En.

The control signal generation circuit 20 outputs the L-level first control signal and H-level second control signal to the corresponding first and second control lines in an arbitrary time period not including the corresponding gate line H-level period, thereby causing the light emitting element 9 to emit light. Also, the control signal generation circuit 20 outputs the H-level first control signal and the L-level second control signal to the corresponding first and second control lines in a period other than the above-mentioned arbitrary time period, including the corresponding gate line H-level period, thereby applying a reverse bias voltage to the light emitting element 9. Referring to FIG. 17, with respect to the arbitrary ith line, the phase relationship between the signals supplied to the gate line Gi, the first control line Ci and the second control line Di is the same as the phase relationship between the signals shown in FIG. 9. If the construction in which signals such as shown in FIG. 17 are applied to the portions of the display 110 is adopted, the life of the light emitting elements 9 can be extended, as in the case described above with reference to FIG. 9.

While, in FIG. 6 showing the signal waveforms of the signals applied to the portions of the display 100 when the light emitting elements 9 are caused to emit light, the L-level voltage signal is supplied to the first control line 6 at all times as an example, a voltage signal which becomes H level only during the gate line 13 H-level period or the selection period may be supplied to the first control line 6 as in FIG. 12. In such a case, the second switching device 2 is in the shutoff state during the first control line 6 H-level period and no current is supplied from the drive section 4 side to the light emitting element 9. In correspondence with this first control line 6 H-level period, the L-level voltage signal may be supplied to the second control line 29. In such a case, a reverse bias voltage can be applied to the light emitting element 9 in the first control line 6 H-level period.

While, in FIG. 8 showing the signal waveforms of the signals applied to the portions of the display 100 when a reverse bias voltage is applied to the light emitting elements 9, the gate line 13 and the data line 3 is supplied with signals similar to those supplied at the time of light emission from the light emitting element 9 as an example, the signals supplied to the gate line 13 and the data line 3 are not limited to this example. When a reverse bias voltage is applied to the light emitting element 9 and when the light emitting element 9 is not caused to emit light, there is no need to generate by the drive section 4 the current according to the data signal supplied to the data line 3. At this time, therefore, the voltage signal supplied to the gate line 13 can be fixed at L level, and the signal supplied to the data line 3 can be a current signal of a current value 0 for setting the value of the current to be supplied to the light emitting element 9 to zero, or a H-level voltage signal. In the pixel circuit 2*e* of the sixth embodiment shown in FIG. 15 in particular, it is preferable to form the data signal supplied to the data line 3 as a current signal of a current value 0 or a H-level voltage signal in order to avoid output of a current from the drive section 4 at the time of application of a reverse bias voltage, since no switching device is placed between the drive section 4 and the light emitting element 9.

While FIG. 17 shows an example of application of signals similar to those shown in FIG. 9 to the portions of the display 110, the signals applied to the portions of the display 110 are not limited to this example. To the portions of the display 110, signals similar to those shown in FIGS. 6 or 12 can be applied as the first and second control signals at the time of light emission from the light emitting element 9. When a reverse bias voltage is applied to the light emitting element 9, signals similar to those shown in FIG. 8 can be applied to as the first and second control signals.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A drive circuit for driving a light emitting element which has a first electrode and a second electrode and which emits light by a forward current flowing through the element between the first electrode and the second electrode, said drive circuit comprising:

a forward drive section which draws out a current from a first power supply line set to a first voltage and supplies the forward current to the light emitting element;

a first switch which establishes a connection between the first electrode and either the forward drive section or a second power supply line set to a second voltage;

a third power supply line connected to the second electrode; and a second switch which establishes a connection between the third power supply line and either a source set to a third voltage or a source set to a fourth voltage, wherein none of the first, second or third power supply lines, supply negative voltages; and wherein, when the the first electrode is connected to the second power supply line, and the third power supply line is connected to the source set to third voltage, which is higher than the second voltage, a reverse current is supplied to the light emitting element between the second power supply line and the third power supply line.

2. The drive circuit according to claim 1, wherein when the forward current is supplied to the light emitting element, the fourth voltage being lower than the third voltage is supplied to the third power supply line instead of the third voltage.

3. The drive circuit according to claim 1, wherein the second switch establishes a connection between said forward drive section and the light emitting element.

4. The drive circuit according to claim 1, wherein the second switch establishes a connection between said forward drive section and the light emitting element, wherein when the forward current is supplied to the light emitting element, the fourth voltage lower than the third voltage is supplied to the third power supply line instead of the third voltage.

5. The drive circuit according to claim 1, wherein the second switch establishes a connection between said forward drive section and the light emitting element, wherein each of said first switch and said second switch is exclusively set in the conductive state in relation to the other.

6. The drive circuit according to claim 1, wherein the second switch establishes a connection between said forward drive section and the light emitting element, wherein:

when the forward current is supplied to the light emitting element, the fourth voltage being lower than the third voltage is supplied to the third power supply line instead of the third voltage; and each of said first switch and said second switch is exclusively set in the conductive state in relation to the other.

7. The drive circuit according to claim 1, wherein the second switch establishes a connection between said forward drive section and the light emitting element, wherein:

each of said first switch and said second switch is exclusively set in the conductive state in relation to the other; and said first switch and said second switch are alternately set in the conductive state.

8. The drive circuit according to claim 1, wherein the second switch establishes a connection between said forward drive section and the light emitting element, wherein:

when the forward current is supplied to the light emitting element, the fourth voltage being lower than the third voltage is supplied to the third power supply line instead of the third voltage;

each of said first switch and said second switch is exclusively set in the conductive state in relation to the other; and said first switch and said second switch are alternately set in the conductive state.

9. A current-control-type light emitting display comprising:

a light emitting element which has a first electrode and a second electrode and which emits light by a forward current flowing through the element between the first electrode and the second electrode;

a forward drive section which draws out a current from a first power supply line set to a first voltage and supplies the forward current to the light emitting element;

a first switch which establishes a connection between the first electrode and either the forward drive section or a second power supply line set to a second voltage;

a third power supply line connected to the second electrode; and a second switch which establishes a connection between the third power supply line and either a source set to a third voltage or a source set to a fourth voltage, wherein none of the first, second or third power supply lines, supply negative voltages; and wherein, when the the first electrode is connected to the second power supply line, and the third power supply line is connected to the source set to a third voltage, which is higher than the second voltage, a reverse current is supplied to the light emitting element between the second power supply line and the third power supply line.

10. The current-control-type light emitting display according to claim 9, wherein when the forward current is supplied to the light emitting element, the fourth voltage being lower than the third voltage is supplied to the third power supply line instead of the third voltage.

11. The current-control-type light emitting display according to claim 9, wherein the second switch establishes a connection between said forward drive section and the light emitting element.

12. The current-control-type light emitting display according to claim 9, wherein the second switch establishes a connection between said forward drive section and the light emitting element, wherein when the forward current is supplied to the light emitting element, the fourth voltage being lower than the third voltage is supplied to the third power supply line instead of the third voltage.

13. The current-control-type light emitting display according to claim 9, wherein the second switch establishes a connection between said forward drive section and the light emitting element, wherein each of said first switch and said second switch is exclusively set in the conductive state in relation to the other.

14. The current-control-type light emitting display according to claim 9, wherein the second switch establishes a connection between said forward drive section and the light emitting element, wherein:

when the forward current is supplied to the light emitting element, the fourth voltage being lower than the third voltage is supplied to the third power supply line instead of the third voltage; and each of said first switch and said second switch is exclusively set in the conductive state in relation to the other.

15. The current-control-type light emitting display according to claim 9, wherein the second switch establishes a connection between said forward drive section and the light emitting element, wherein:

each of said first switch and said second switch is exclusively set in the conductive state in relation to the other; and said first switch and said second switch are alternately set in the conductive state.

16. The current-control-type light emitting display according to claim 9, wherein the second switch establishes a connection between said forward drive section and the light emitting element, wherein:

when the forward current is supplied to the light emitting element, the fourth voltage being lower than the third voltage is supplied to the third power supply line instead of the third voltage;

each of said first switch and said second switch is exclusively set in the conductive state in relation to the other; and said first switch and said second switch are alternately set in the conductive state.

17. A current-control-type light emitting display comprising a plurality of data lines for supplying luminance data, a plurality of gate lines for supplying gate signals, a light emitting array in which a plurality of pixel circuits each being connected with said data line and said gate line are arrayed in matrix form, each of said pixel circuit including:

a light emitting element which has a first electrode and a second electrode and which emits light by a forward current flowing through the element between the first electrode and the second electrode;

a forward drive section which draws out, in response to the gate signal, a current from a first power supply line set to a first voltage, the current being controlled on the basis of the luminance data, and which supplies the forward current to said light emitting element; and a first switch which establishes a connection between the first electrode and either the forward drive section or a second power supply line set to a second voltage;

a third power supply line connected to the second electrode and laid in correspondence with the row; and a second switch which establishes a connection between the third power supply line and either a source set to a third voltage or a source set to a fourth voltage, wherein none of the first, second or third power supply lines, supply negative voltages; and wherein when the the first electrode is connected to the second power supply line, and the third power supply line is connected to the source set to a third voltage, which is higher than the second voltage a reverse current is supplied to said light emitting element between the second power supply line and the third power supply line.

18. The current-control-type light emitting display according to claim 17, wherein when the forward current is supplied to said light emitting element, the fourth voltage being lower than the third voltage is supplied to the third power supply line instead of the third voltage.

19. The current-control-type light emitting display according to claim 17, wherein the second switch establishes a connection between said forward drive section and said light emitting element.

20. The current-control-type light emitting display according to claim 17, wherein the second switch establishes a connection between said forward drive section and said light emitting element, wherein when the forward current is supplied to said light emitting element, the fourth voltage lower than the third voltage is supplied to the third power supply line instead of the third voltage.

21. The current-control-type light emitting display according to claim 17, wherein the second switch establishes a connection between said forward drive section and said light emitting element, wherein each of said first switch and said second switch is exclusively set in the conductive state in relation to the other.

22. The current-control-type light emitting display according to claim 17, wherein the second switch establishes a connection between said forward drive section and said light emitting element, wherein:

when the forward current is supplied to said light emitting element, the fourth voltage being lower than the third voltage is supplied to the third power supply line instead of the third voltage; and each of said first switch and said second switch is exclusively set in the conductive state in relation to the other.

23. The current-control-type light emitting display according to claim 17, wherein the second switch establishes a connection between said forward drive section and said light emitting element, wherein:

each of said first switch and said second switch is exclusively set in the conductive state in relation to the other; and said first switch and said second switch are alternately set in the conductive state.

24. The current-control-type light emitting display according to claim 17, wherein the second switch establishes a connection between said forward drive section and said light emitting element, wherein:

when the forward current is supplied to said light emitting element, the fourth voltage being lower than the third voltage is supplied to the third power supply line instead of the third voltage;

each of said first switch and said second switch is exclusively set in the conductive state in relation to the other; and said first switch and said second switch are alternately set in the conductive state.

25. The current-control-type light emitting display according to claim 17, wherein the luminance data is a voltage signal and said forward drive section includes a third switch having a control terminal connected to the gate line, a current control device having a control terminal connected to the data line via the third switch, and a capacitor which holds the potential on the control terminal of the current control device.

26. The current-control-type light emitting display according to claim 18, wherein the luminance data is a voltage signal and said forward drive section includes a third switch having a control terminal connected to the gate line, a current control device having a control terminal connected to the data line via the third switch, and a capacitor which holds the potential on the control terminal of the current control device.

27. The current-control-type light emitting display according to claim 19, wherein the luminance data is a voltage signal and said forward drive section includes a third switch having a control terminal connected to the gate line, a current control device having a control terminal connected to the data line via the third switch, and a capacitor which holds the potential on the control terminal of the current control device.

28. The current-control-type light emitting display according to claim 20, wherein the luminance data is a voltage signal and said forward drive section includes a third switch having a control terminal connected to the gate line, a current control device having a control terminal connected to the data line via the third switch, and a capacitor which holds the potential on the control terminal of the current control device.

29. The current-control-type light emitting display according to claim 21, wherein the luminance data is a voltage signal and said forward drive section includes a third switch having a control terminal connected to the gate line, a current control device having a control terminal connected to the data line via the third switch, and a capacitor which holds the potential on the control terminal of the current control device.

30. The current-control-type light emitting display according to claim 22, wherein the luminance data is a voltage signal and said forward drive section includes a third switch having a control terminal connected to the gate line, a current control device having a control terminal connected to the data line via the third switch, and a capacitor which holds the potential on the control terminal of the current control device.

31. The current-control-type light emitting display according to claim 23, wherein the luminance data is a voltage signal and said forward drive section includes a third switch having a control terminal connected to the gate line, a current control device having a control terminal connected to the data line via the third switch, and a capacitor which holds the potential on the control terminal of the current control device.

32. The current-control-type light emitting display according to claim 24, wherein the luminance data is a voltage signal and said forward drive section includes a third switch having a control terminal connected to the gate line, a current control device having a control terminal connected to the data line via the third switch, and a capacitor which holds the potential on the control terminal of the current control device.

33. The current-control-type light emitting display according to claim 17, wherein the luminance data is a current signal and said forward drive section has a current mirror structure such that the data line is on the reference side and said light emitting element is on the output side.

34. The current-control-type light emitting display according to claim 18, wherein the luminance data is a current signal and said forward drive section has a current mirror structure such that the data line is on the reference side and said light emitting element is on the output side.

35. The current-control-type light emitting display according to claim 19, wherein the luminance data is a current signal and said forward drive section has a current mirror structure such that the data line is on the reference side and said light emitting element is on the output side.

36. The current-control-type light emitting display according to claim 20, wherein the luminance data is a current signal and said forward drive section has a current mirror structure such that the data line is on the reference side and said light emitting element is on the output side.

37. The current-control-type light emitting display according to claim 21, wherein the luminance data is a current signal and said forward drive section has a current mirror structure such that the data line is on the reference side and said light emitting element is on the output side.

38. The current-control-type light emitting display according to claim 22, wherein the luminance data is a current signal and said forward chive section has a current mirror structure such that the data line is on the reference side and said light emitting element is on the output side.

39. The current-control-type light emitting display according to claim 23, wherein the luminance data is a current signal and said forward drive section has a current mirror structure such that the data line is on the reference side and said light emitting element is on the output side.

40. The current-control-type light emitting display according to claim 24, wherein the luminance data is a current signal and said forward drive section has a current mirror structure such that the data line is on the reference side and said light emitting element is on the output side.

41. The current-control-type light emitting display according to claim 19, wherein the luminance data is a current signal and said forward drive section includes third and fourth switches each having a control terminal connected to the gate line, a current control device having a control terminal connected to the data line via the third and fourth switches, and a capacitor which holds the potential on the control terminal of the current control device, a node through which the third and fourth switches are connected in series and a node through which the current control device and said second switch are connected being connected to each other.

42. The current-control-type light emitting display according to claim 20, wherein the luminance data is a current signal and said forward drive section includes third and fourth switches each having a control terminal connected to the gate line, a current control device having a control terminal connected to the data line via the third and fourth switches, and a capacitor which holds the potential on the control terminal of the current control device, a node through which the third and fourth switches are connected in series and a node through which the current control device and said second switch are connected being connected to each other.

43. The current-control-type light emitting display according to claim 21, wherein the luminance data is a current signal and said forward drive section includes third and fourth switches each having a control terminal connected to the gate line, a current control device having a control terminal connected to the data line via the third and fourth switches, and a capacitor which holds the potential on the control terminal of the current control device, a node through which the third and fourth switches are connected in series and a node through which the current control device and said second switch are connected being connected to each other.

44. The current-control-type light emitting display according to claim 22, wherein the luminance data is a current signal and said forward drive section includes third and fourth switches each having a control terminal connected to the gate line, a current control device having a control terminal connected to the data line via the third and fourth switches, and a capacitor which holds the potential on the control terminal of the current control device, a node through which the third and fourth switches are connected in series and a node through which the current control device and said second switch are connected being connected to each other.

45. The current-control-type light emitting display according to claim 23, wherein the luminance data is a current signal and said forward drive section includes third and fourth switches each having a control terminal connected to the gate line, a current control device having a control terminal connected to the data line via the third and fourth switches, and a capacitor which holds the potential on the control terminal of the current control device, a node through which the third and fourth switches are connected in series and a node through which the current control device and said second switch are connected being connected to each other.

46. The current-control-type light emitting display according to claim 24, wherein the luminance data is a current signal and said forward drive section includes third and fourth switches each having a control terminal connected to the gate line, a current control device having a control terminal connected to the data line via the third and fourth switches, and a capacitor which holds the potential on the control terminal of the current control device, a node through which the third and fourth switches are connected in series and a node through which the current control device and said second switch are connected being connected to each other.

* * * * *